US005452067A

United States Patent [19]

Matsuo et al.

[11] Patent Number: 5,452,067

[45] Date of Patent: Sep. 19, 1995

[54] DOCUMENT CONVEYOR BELT RELEASE MECHANISM

[75] Inventors: Takeshi Matsuo; Masayuki Kakuta; Tsuyoshi Nagao, all of Osaka, Japan

[73] Assignee: Mita Industrial Co., Ltd., Osaka, Japan

[21] Appl. No.: 231,474

[22] Filed: Apr. 22, 1994

Related U.S. Application Data

[62] Division of Ser. No. 74,413, Jun. 9, 1993, Pat. No. 5,367,370.

[30] Foreign Application Priority Data

Jun. 11, 1992 [JP] Japan ..... 4-151955
Jun. 12, 1992 [JP] Japan ..... 4-153647
Jun. 25, 1992 [JP] Japan ..... 4-167165

[51] Int. Cl.[6] ..... G03G 21/00
[52] U.S. Cl. ..... 355/309; 271/198
[58] Field of Search ..... 355/308, 309, 321; 271/3, 198; 198/814, 860.1, 861.1, 842

[56] References Cited

U.S. PATENT DOCUMENTS

| | | | |
|---|---|---|---|
| 1,792,195 | 2/1931 | Stresau et al. | 198/842 |
| 3,878,937 | 4/1975 | Glaser et al. | 198/835 |
| 4,214,832 | 7/1980 | Kono et al. | 355/233 |
| 4,439,036 | 3/1984 | Davis et al. | 355/75 |
| 4,620,782 | 11/1986 | Kurando et al. | 355/311 |
| 4,922,292 | 5/1990 | Watanabe | 355/75 |
| 5,033,728 | 7/1991 | Miura et al. | 271/3 |
| 5,060,923 | 10/1991 | Takimoto et al. | 271/7 |
| 5,126,787 | 6/1992 | Irie et al. | 355/308 X |
| 5,127,642 | 7/1992 | Takimoto et al. | 271/3 |
| 5,143,363 | 9/1992 | Irie et al. | 355/320 X |
| 5,220,393 | 6/1993 | Otomo | 355/308 |
| 5,292,113 | 3/1994 | Morigami et al. | 271/198 X |

FOREIGN PATENT DOCUMENTS

| | | |
|---|---|---|
| 0367249 | 5/1990 | European Pat. Off. . |
| 0421330 | 4/1991 | European Pat. Off. . |
| 0535648 | 4/1993 | European Pat. Off. . |
| 3220140 | 12/1983 | Germany . |
| 53-91747 | 8/1978 | Japan . |
| 60-118551 | 6/1985 | Japan . |
| 60-137740 | 7/1985 | Japan . |
| 61-49348 | 4/1986 | Japan . |
| 62-105839 | 5/1987 | Japan . |
| 62-105840 | 5/1987 | Japan . |
| 62-191367 | 8/1987 | Japan . |
| 4-95977 | 3/1992 | Japan . |
| 5-88486 | 4/1993 | Japan . |
| 2041335 | 9/1980 | United Kingdom . |

*Primary Examiner*—A. T. Grimley
*Assistant Examiner*—Nestor R. Ramirez
*Attorney, Agent, or Firm*—Antonelli, Terry, Stout & Kraus

[57] ABSTRACT

An automatic document conveyor for an image processing machine having an endless belt with a driven roller and a follower roller. The endless belt mechanism includes a front frame and a rear frame which are coupled together a distance apart in the direction substantially perpendicular to the longitudinal direction of the endless belt. First and second movable frames are coupled to first ends of each of the front frame and the rear frame and support the follower roller. A third movable frame is coupled to the second end of the front frame. The driven roller is supported by the third movable frame and the second end of the rear frame, and a drive source is coupled to the end of the driven roller adjacent the rear frame. Springs urge the three movable frames in directions tensioning the endless belt. The first and second movable frames can be moved against their springs to release the tension of the follower roller on the endless belt. The third movable frame can be moved against its spring to release the tension of the driven roller on the endless belt while retaining the coupling of the endless belt with the drive source.

2 Claims, 17 Drawing Sheets

DOCUMENT CONVEYOR BELT RELEASE MECHANISM

This application is a division of application Ser. No. 08/074,413, filed Jun. 9, 1993, now U.S. Pat. No. 5,367,370.

FIELD OF THE INVENTION

The present invention relates to an automatic document feeder that is employed on an image processing machine such as an electrostatic copying machine or an image reader.

DESCRIPTION OF THE PRIOR ART

A platen glass is provided on the upper surface of a housing of an image processing machine such as an electrostatic copying machine. On the upper surface of the housing is further mounted an automatic document feeder (hereinafter simply referred to as ADF). In order to automatically process the documents, in recent years, there have been proposed and practically used ADFs of a variety of types by which the documents to be copied or read out are conveyed onto a predetermined position on the platen glass and are then carried away from the platen glass. Typical examples of the ADF have been disclosed in, for example, Japanese Laid-Open Patent Publication No. 229,744/1986 and Japanese Laid-Open Patent Publication No. 295,334/1988.

In a typical ADF, a main frame is mounted on the housing of an electrostatic copying machine (hereinafter simply referred to as copying machine) to pivot on the pivot axis of the main frame between a closed position and an open position thereof. The pivot axis of the main frame is so positioned as to extend along an edge of the platen glass on the back side (rear side) of the copying machine. The main frame is usually a unit body of nearly a box-like shape whose upper surface and side surfaces are covered with a plastic covering and whose lower surface is open. The main frame covers the platen glass when it is brought to the closed position and exposes the upper surface of the platen glass when it is brought to the open position. The main frame is required to be opened and closed to place the document on the platen glass by hand. A paper feeding unit is provided at the one end of the main frame (on the left side of the copying machine) and a paper discharging unit is provided at the other end thereof (on the right side of the copying machine). The main frame is provided with a document-placing table and a document discharging tray. The document-placing table is provided for the paper feeding unit, and the document discharging tray is formed on the upper surface of the covering between the paper feeding unit and the paper discharging unit. The paper feeding unit includes a document introduction passage that leads from the document-placing table onto the platen glass, and the paper discharging unit includes a document delivery passage that leads from the platen glass to the document discharging tray. The document-placing table is mounted onto the paper feeding unit on the side of the inlet of the document introduction passage. The document discharging tray is formed on the upper surface of the covering between the paper feeding unit and the paper discharging unit. There is disposed a document conveying means which conveys the document via the document introduction passage, upper surface of the platen glass and the document delivery passage. The document conveying means includes a document introduction means which conveys the document through the document introduction passage, a conveyor belt mechanism which conveys the document along the upper surface of the platen glass, and a document delivery means which conveys the document through the document delivery passage. The conveyor belt mechanism is provided between the paper feeding unit and the paper discharging unit. More concretely speaking, the conveyor belt mechanism is positioned under the covering between the paper feeding unit and the paper discharging unit, i.e., positioned under the document discharging tray. When the main frame is brought to the closed position, the conveyor belt mechanism is positioned with its face toward the platen glass. The conveyor belt mechanism includes a pair of support means space apart in the back-and-forth direction, a driven roller and a follower roller which are supported at both ends thereof, and an endless belt (hereinafter simply referred to as belt) wrapped round these rollers.

The paper feeding unit includes an open/close frame that is supported to pivot on the pivot axis of the open/close frame and that extends substantially perpendicularly to the pivot axis of the main frame. The main frame is provided with an upright front side plate and an upright rear side plate disposed spaced at a distance from each other in the direction of the pivot axis of the open/close frame. Furthermore, the open/close frame is provided with a front wall plate and a rear wall plate disposed in the axial direction spaced at a distance smaller than the above distance. The front wall plate and the rear wall plate of the open/close frame are rotatably supported by the upright front side plate and the upright rear side plate via bearing means, and the open/close frame is thus supported to pivot with respect to the main frame. The main frame is provided with a first introduction passage defining means, and the open/close frame is provided with a second introduction passage defining means. The document introduction passage is partly defined by the first introduction passage defining means and the second introduction passage defining means. The above-mentioned part of the document introduction passage becomes open when the open/close frame is pivoted from the closed position to the open position. The document introduction means which conveyors the document through the document introduction passage includes introduction rollers located on the most upstream side of the document introduction passage, feed rollers located on the downstream side thereof, and separation rollers mounted on the open/close frame to come in contact with or separate away from the feed rollers. Discharge rollers are included in the document delivery means that discharges the document through the document delivery passage of the paper discharging unit. The documents from the discharge rollers are discharged onto the document discharging tray through the discharging port of the paper discharging unit and are stacked. The document-placing table provided for the paper feeding unit is positioned extending over the document discharging tray.

However, the conventional ADF has the following problems that must be solved.

A first problem is concerned with adjusting the deviation between the optical axis of the copying machine (center line of the copying machine in the direction of width, i.e., in the back-and-forth direction) and the center line in the back-and-forth of documents fed by the ADF. In assembling the ADF on the copying machine, so far, the position of the whole ADF is made adjustable in the back-and-forth direction relative to the copying machine so that the above deviation can be adjusted. In a large copying machine which is designed to deal with a document having a maximum size, e.g., A2 size stipulated under the JIS, however, the operator must exert a great effort to adjust the optical axis by moving the whole ADF back and forth, causing the operation efficiency to be greatly impaired. On the other hand, it can further be contrived to adjust the optical axis by moving the paper feeding unit back and forth. When the paper feeding unit is moved, however, a problem arises in regard to fitness to the covering of the ADF, making it difficult to fully solve the above-mentioned problem.

A second problem is concerned with wiring of the electric wires between the main frame and the open/close frame that is mounted thereon to be opened and closed. That is, the open/close frame is provided with electric elements such as a variety of detectors, and the electric wires are laid on between the main frame and the open/close frame to connect the electric elements to the power source. Therefore, the electric wires must be so laid as to not interrupt the operation for opening and closing the open/close frame and further as to not be damaged by the opening and closing operations. So far, therefore, a hole is formed in one side wall of the open/close frame at a position away from the pivot axis portion of the open/close frame and the electric wires are passed through this hole, or the shaft of the open/close frame is supported by a hollow bearing and the electric wires are passed through the hole of the bearing. In the former case, however, a mechanism is necessary to adjust the movement of electric wires at the opening and closing operations and, besides, the electric wires are very likely to be deteriorated or damaged by the opening and closing operations. In the latter case, on the other hand, a connector of such a size that it does not pass through the hole of the bearing is coupled to the electric wires on the side of the open/close frame. That is, the electric wires must be passed through the hole of the bearing prior to assembling the bearing and then be connected to the connector, requiring cumbersome operation for assembling the wiring and the open/close frame and causing the operation efficiency to be greatly decreased.

A third problem is concerned with stacking of the documents discharged from the paper discharging unit on the document discharging tray. The documents discharged from the discharge port of the paper discharging unit must be orderly stacked at a predetermined position on the document discharging tray at all times irrespective of the size of documents and the number of pieces thereof. In order to easily and efficiently achieve this object, it has been known to provide the document discharging tray with an ascending inclination that rises toward the document-discharging direction. In the aforementioned conventional ADF, the paper feeding unit is provided with the document-placing table mounted in a manner that it extends over the document discharging tray, imposing a limitation on the height of the document discharging tray that results from saving the space. When a document of a large size such as the A2 size is to be treated, on the other hand, a predetermined space is required between the document discharging tray and the document-placing table. For this purpose, the discharging tray is provided with a descending inclination that descends toward the document-discharging direction and that is continuous to the above-mentioned ascending inclination. When a vertex formed by these two inclinations, i.e., the position at which the inclination changes is too close to the discharge port of the paper discharging unit, the document is separated from the discharge port by more than a predetermined distance due to the inertia. As a result, the trailing end of the document is not brought into the predetermined position, that results in the high likelihood that the succeeding document gets in under the preceding document to cause an improper stacking of the documents.

Fourth, when the main frame is located at the closed position, the endless belt in the conveyor belt mechanism positioned with its face toward the platen glass directly covers the document that is located on the platen glass and also works as means for reflecting the light that is projected onto the document and the periphery thereof. When stained due to repetitive use, therefore, the endless belt must be renewed. To facilitate the operation of replacement, means is provided to relax the tension of the belt. According to one example of the means, a movable member is used at one end of each of the pair of support means, both ends of the follower roller are supported by the movable members, and the movable members or both ends of the follower roller are allowed to be inwardly moved when the tension of the belt is to be relaxed. According to this means, however, the movable members must have an increased length and must be moved by an increased amount when the belt is long. In other words, the movable members are not very stably supported under the condition where the belt is under tension, and vibration generates when the belt is driven.

According to another example of the means, the movable member is employed not only at one end but also at the other end of the pair of support means, both ends of the follower roller and of the driven roller are supported by the movable members, and both ends of each of the follower roller and the driven roller are allowed to be inwardly moved when the tension of the belt is to be relaxed. According to this means, the one end of the driven roller drivably coupled to the drive source must also be moved, and the driving coupling between the driven roller and the drive source must be disconnected when the belt is to be relaxed. Accordingly, replacement of the belt involves cumbersome operation and requires extended periods of time.

Fifth, the document-placing table is attached to the paper feeding unit in a manner of extending over above the document discharging tray from an end of the paper feeding unit. The document-placing table is detachably mounted on the paper feeding unit by using a plurality of fastening screws. Therefore, the mounting requires cumbersome operation and extended periods of time. Removal for the purpose of maintenance and the like, too, requires cumbersome operation and extended periods of time. Moreover, a large number of parts must be used.

SUMMARY OF THE INVENTION

A first object of the present invention is to provide an improved ADF which makes it possible to very easily adjust the deviation between the optical axis of the image forming machine and the center line of the document fed by the ADF in the back-and-forth direction without the need of moving the whole ADF.

A second object of the present invention is to provide an improved ADF which enables the assembling operation to be satisfactorily carried out notwithstanding that the electric wires connecting the main frame to the open/close frame that is mounted thereon to be opened and closed, are laid on passing through the hole of the bearing of the open/close frame.

A third object of the present invention is to provide an improved ADF which guarantees satisfactory stacking of documents at all times irrespective of the size of the documents.

A fourth object of the present invention is to provide an improved ADF which makes it possible to replace the belt very easily without the need of disconnecting the driving coupling between the driven roller and the rotary drive source when the tension of the belt is relaxed.

A fifth object of the present invention is to provide an improved ADF which enables the document-placing table to be easily attached or detached with one-touch operation and without using screws for fastening.

In order to achieve the above first object according to a first aspect of the present invention, the document-placing table is mounted on a table support means that is provided for the paper feeding unit, the document-placing table being allowed to move in the back-and-forth direction with respect to the image forming machine so that its position can be adjusted.

That is, in order to achieve the above first object according to a first aspect of the present invention, there is provided an automatic document feeder in which a main frame is so mounted as to be pivoted between a closed position and an open position with respect to a platen glass provided on the housing of an image forming machine, a paper feeding unit is provided at one end of said main frame, a paper discharging unit is provided at the other end, a conveyor belt mechanism is disposed, with its face toward said platen glass at the position where said main frame is closed, between said paper feeding unit and said paper discharging unit, a document-placing table is attached to said paper feeding unit, said paper feeding unit is provided with a table support means, and said document-placing table is so mounted on said table support means that its position can be adjusted by its movement in the back-and-forth direction of said image forming machine.

In order to achieve the above second object according to a second aspect of the present invention, a notch is formed in each of the support holes formed in one of the neighboring upright side plates of the main frame and in one of the side wall plates of the open/close frame, such that the electric wire can be passed through said support holes from the ends of the plates, and a hollow bearing is held by the upright side plates penetrating through the support holes, the hollow bearing being split into two with respect to a split plane that extends in the axial direction thereof.

That is, in order to achieve the above second object according to a second aspect of the present invention, there is provided an automatic document feeder in which a main frame is so mounted as to be pivoted between a closed position and an open position with respect to the platen glass provided on the housing of an image forming machine, a paper feeding unit is provided at one end of said main frame, a paper discharging unit is provided at the other end, a conveyor belt mechanism is disposed, with its face toward said platen glass at the position where said main frame is closed, between said paper feeding unit and said paper discharging unit, said paper feeding unit includes an open/close frame that has a pair of side wall plates, said main frame is provided with a pair of upright side plates that are neighboring on the outer side of said side wall plates of said open/close frame, said side wall plates are supported by said upright side plates via bearing means, said open/close frame is so mounted as to be pivoted between a closed position and an open position with respect to said main frame, said bearing means includes at least one hollow bearing, and the electric wires that connect said main frame to said open/close frame are laid through the hole of said hollow bearing, support holes having a common axis are formed in one of said side wall plates and in one of said upright side plates neighboring said side wall, a notch is formed in one of said side wall plates and in one of said upright side plates, the notch extending from an end of each of them to said support holes, each of said notches is so positioned as to match with the axial direction of said bearing at the position where said open/close frame is closed and has a width that permits the passage of said electric wire, and said hollow bearing is secured to one of said upright side plates and is so positioned as to penetrate through each of said support holes, said support hole of one of said side wall plates is allowed to turn with respect to the outer peripheral surface of said hollow bearing, and said hollow bearing is formed split into two with respect to a split plane that extends in the axial direction thereof.

In order to achieve the above third object according to a third aspect of the present invention, the vertex defined by the ascending inclination and the descending inclination formed on the document discharging tray is located at a position which is separated away from the discharge port of the paper discharging unit toward the document discharging direction by more than one-half the maximum document size that is used.

That is, in order to achieve the above third object according to a third aspect of the present invention, there is provided an automatic document feeder in which a main frame is so mounted as to be pivoted between a closed position and an open position with respect to the platen glass Provided on the housing of an image forming machine, a paper feeding, unit is provided at one end of said main frame, a paper discharging unit is provided at the other end, a conveyor belt mechanism is disposed, with its face toward said platen glass at the position where said main frame is closed, between said paper feeding unit and said paper discharging unit, a document discharging tray on which the documents discharged from the discharge port of said paper discharging unit will be stacked is provided at a position above said conveyor belt mechanism, a document-placing table is attached to said paper feeding unit in a manner to extend over said document discharging tray, and said document discharging tray is provided with an ascending inclination that rises toward the direction in which the document is discharged and a descending inclination which is continuous to said ascending inclination and which descends toward the direction in which the document is discharged, wherein the vertex defined by said inclinations of said document discharging tray is located at a position which is separated away from the discharge port of said paper discharging unit toward said document discharging direction by more than one-half the maximum document size that is used.

In order to achieve the above fourth object according to a fourth aspect of the present invention, a movable frame is coupled to one end of each of a front side frame and a rear side frame of the conveyor belt mechanism and to the other end of the front side frame, respectively, via a spring means in a manner to be moved in the lengthwise direction thereof, and a driven roller and a follower roller round which an endless belt is wrapped are supported by said movable frames.

That is, in order to achieve the above fourth object according to the fourth aspect of the present invention, there is provided an automatic document feeder in which a main frame is so mounted as to be pivoted between a closed position and an open position with respect to the platen glass provided on the housing of an image forming machine, a paper feeding unit is provided at one end of said main frame, a paper discharging unit is provided at the other end, and a conveyor belt mechanism is disposed, with its face toward said platen glass at the position where said main frame is closed, between said paper feeding unit and said paper discharging unit, and:

said conveyor belt mechanism includes a front side frame and a rear side frame that are disposed at a distance, in the back-and-forth direction of said image forming machine and coupling means that couple them together;

a movable frame is coupled to one end of each of said front side frame and said rear side frame and to the other end of said front side frame, respectively, in a manner to be moved in the lengthwise direction;

spring means are provided between the movable frame and the one end of each of said front side frame and said rear side frame, and between the movable frame and the other end of said front side frame, to urge said movable frames toward the directions away from said front side frame and said rear side frame and from the other end of said front side frame;

both ends of the follower roller are supported by said movable frames coupled to said one end of each of the front side frame and the rear side frame; and one end of the driven roller is supported by said movable frame coupled to the other end of said front side frame, the other end of said driven roller is supported by the other end of said rear side frame, an endless belt is wrapped round said driven roller and said follower roller, and the other end of said driven roller is drivably coupled to a drive source that is provided at the other end of said rear side frame.

In order to achieve the above fifth object according to a fifth aspect of the present invention, notches for mounting are formed on the side of the document-placing table, support pins are provided on the side of the paper feeding unit, and the notch is detachably engaged with the support pin, so that the document-placing table is detachably mounted on the paper feeding unit.

That is, in order to achieve the above fifth object according to the fifth aspect of the present invention, there is provided an automatic document feeder in which a main frame is so mounted as to be pivoted between a closed position and an open position with respect to the platen glass provided on the housing of an image forming machine, a paper feeding unit is provided at one end of said main frame, a paper discharging unit is provided at the other end, and a conveyor belt mechanism is disposed, with its face toward said platen glass at the position where said main frame is closed, between said paper feeding and said paper discharging unit, and:

said paper feeding unit is provided with two support pins in a protruded manner spaced at a distance from each other in the back-and-forth direction of said image forming machine;

a flange which extends downwards is formed at an end of said document-placing table, two notches for mounting are formed in said flange at a distance, one of said notches is constituted by a vertical notch that upwardly extends from the lower end of said flange and a lateral notch that extends in the lateral direction from the upper end of said vertical notch, and the other notch for mounting is constituted by a vertical notch that upwardly extends from the lower end of said flange;

said lateral notch of said one notch for mounting engages with one of said support pins, and said other notch for mounting engages with the other support pin, so that said document-placing table is detachably mounted on said paper feeding unit; and said one notch for mounting is positioned on the front side of said image forming machine under the condition where said document-placing table is mounted.

DETAILED DESCRIPTION OF THE PREFERRED EMBODIMENTS

The present invention will now be described in further detail with reference to the accompanying drawings that illustrate preferred embodiments of the ADF constituted according to the present invention.

Figure 1:
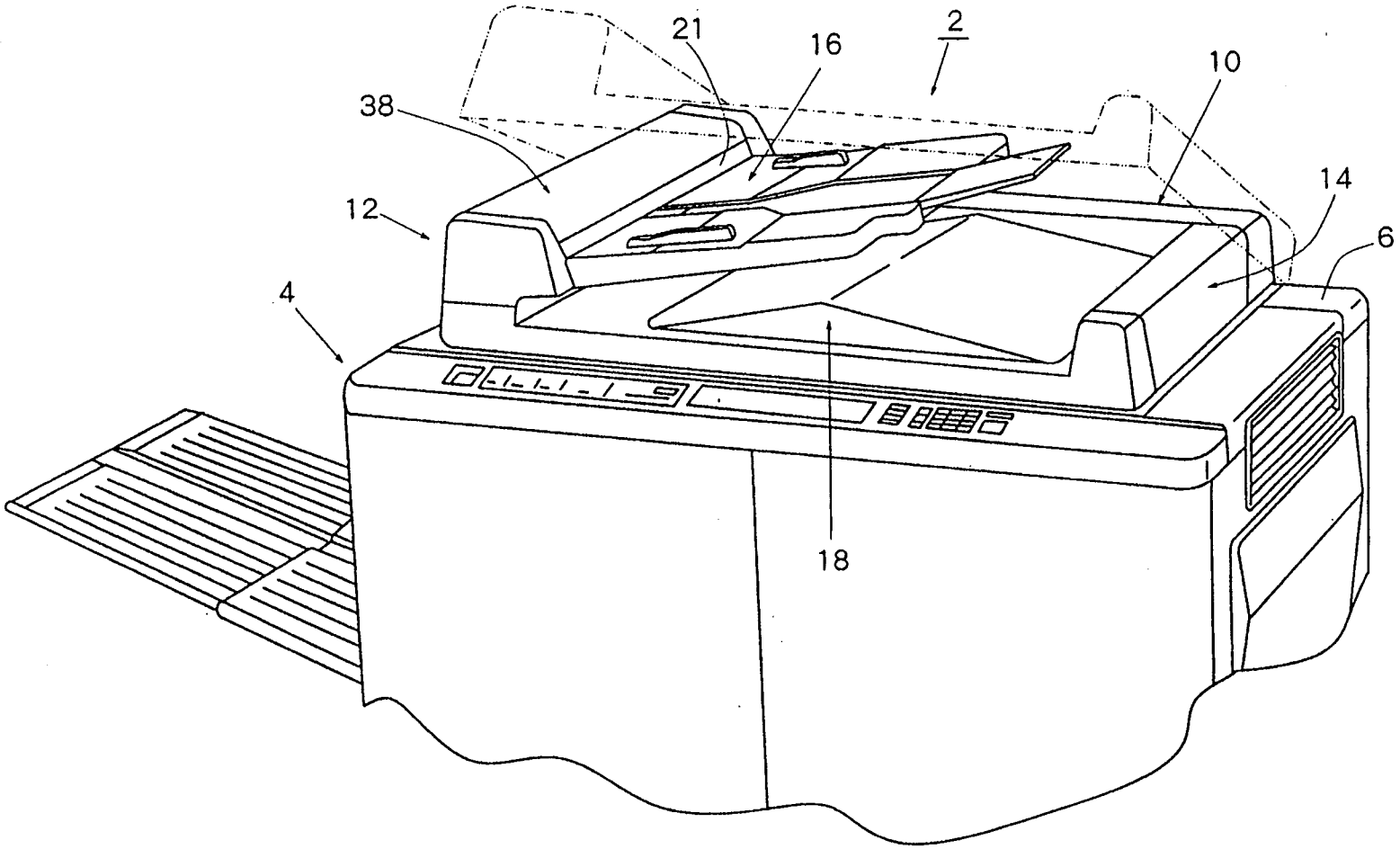
FIG. 1 is a perspective view showing the state where a preferred embodiment of an automatic document feeder constituted according to the first to fifth aspects of the present invention is mounted on an electrostatic copying machine.
Figure 2:
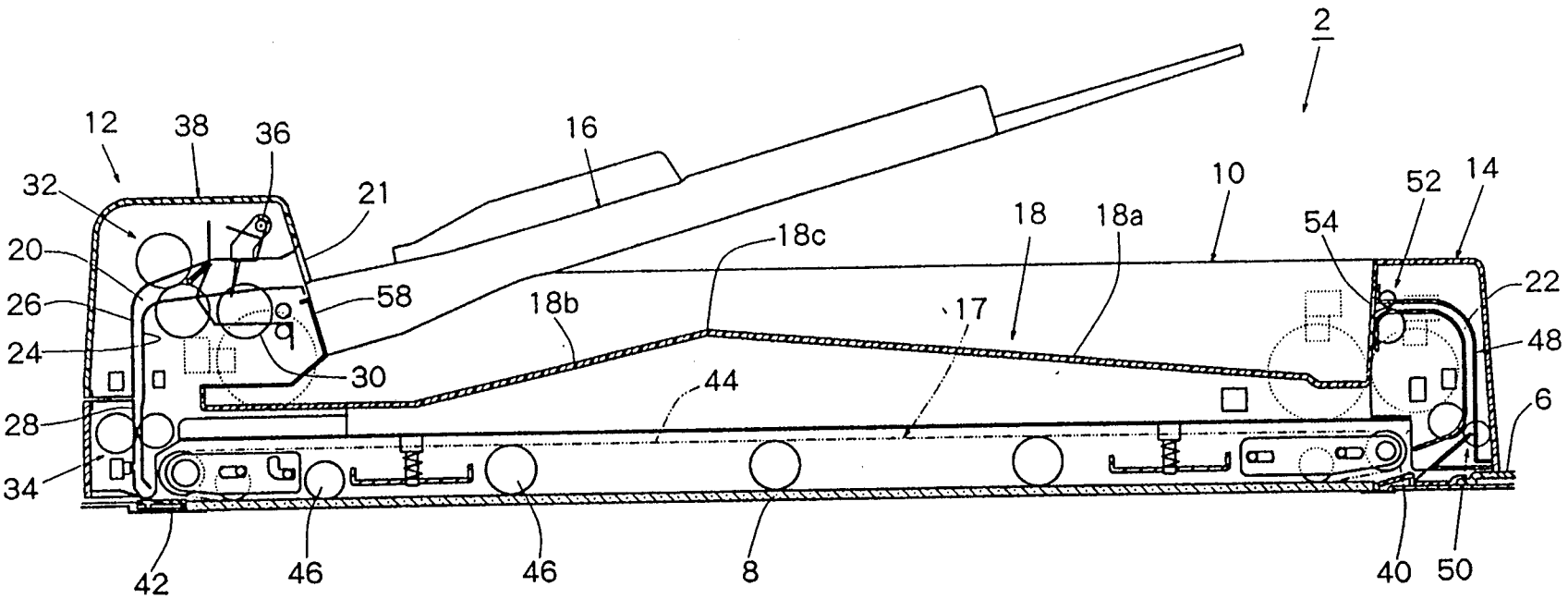
FIG. 2 is a sectional view which schematically illustrates the automatic document feeder of FIG. 1.
Figure 3:
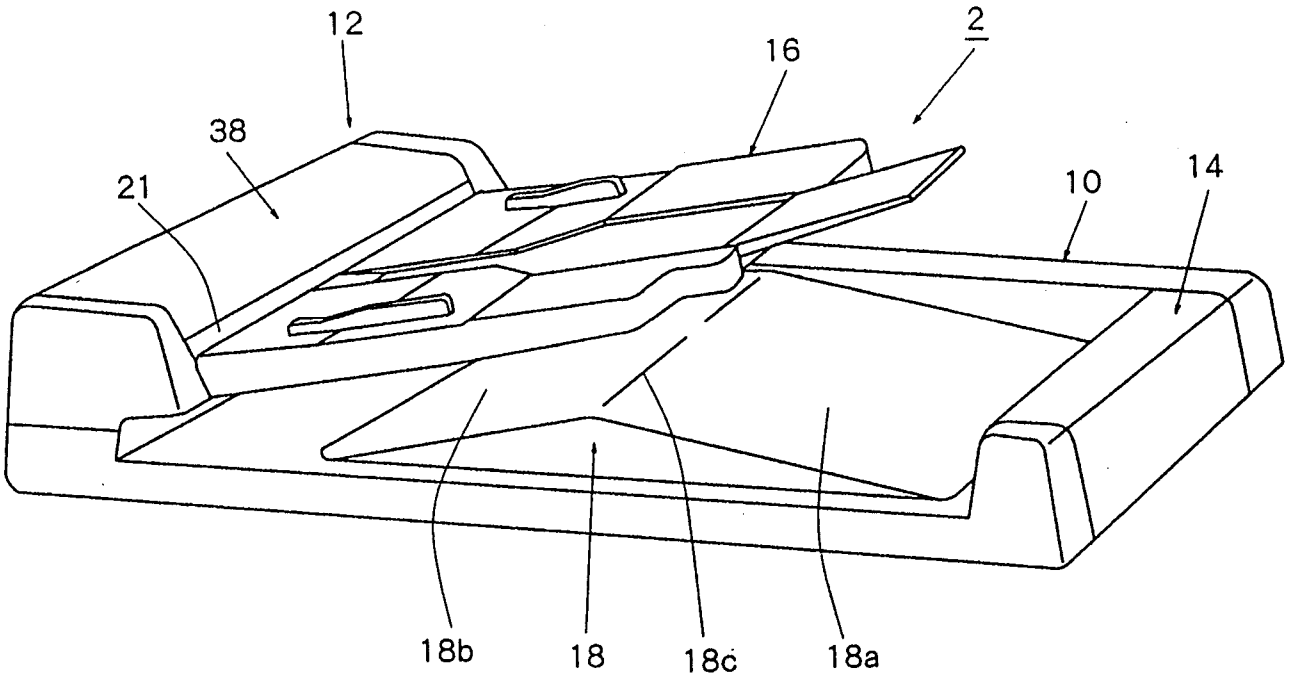
FIG. 3 is a perspective view showing the automatic document feeder of FIG. 1.

With reference to FIGS. 1 to 3, the ADF which as a whole is designated at 2 is applied to a copying machine 4 in the illustrated embodiment. In this specification, the front side refers to the front side of the copying machine 4 shown in FIG. 1; the rear side, the back side of the copying machine 4; the right side, the right side of the copying machine 4; and the left side, the left side of the copying machine 4. The copying machine 4 has a housing 6 of nearly a rectangular parallelepiped shape, and a platen glass 8 (FIG. 2) is provided on the upper surface of the housing 6. A document to be copied is placed at a predetermined position on the platen glass 8. The copying machine 4 itself may be one which is known per se., and so it is not described here. The ADF 2 has a main frame 10 that is so mounted as to be pivoted between a closed position and an open position with respect to the platen glass 8 provided on the housing. The pivot axis (not shown) of the main frame 10 is so positioned as to extend along one edge of the platen glass 8 on the rear side of the copying machine 4. The main frame 10 consists of a nearly box-shaped unit body with its upper and side surfaces covered with a plastic covering and with its lower surface open. The main frame 10 at its closed position covers the platen glass 8, and at its open position permits the upper surface of the platen glass 8 to be exposed. A paper feeding unit 12 is provided at the one end of the main frame 10 (on the left side of the copying machine) and a paper discharging unit 14 is provided at the other end (on the right side of the copying machine). The main frame 10 is further provided with a document-placing table 16 and a document discharging tray 18. The document-placing table 16 is attached to the paper feeding unit 12, and the document discharging tray 18 is formed on the upper surface of the covering between the paper feeding unit 12 and the paper discharging unit 14. The paper feeding unit 12 includes a document introduction passage 20 that leads from the document-placing table 16 onto the platen glass 8, and the paper discharging unit 14 includes a document delivery passage 22 that leads from the upper surface of the platen glass 8 to the document discharging tray 18. The document-placing table 16 is attached to the paper feeding unit 12 on the inlet side of the document introduction passage 20. A conveyor belt mechanism 17 is provided on the lower side of the covering, i.e., on the lower side of the document discharging tray 18 between the paper feeding unit 12 and the paper discharging unit 14.

A document conveying means is arranged to convey documents through the document introduction passage 20, upper surface of the platen glass 8, and document delivery passage 22. The document conveying means includes a document introduction means which conveys the document through the document introduction passage 20, the conveyor belt mechanism 17 that conveys the document along the upper surface of the platen glass 8, and a document delivery means which conveys the document through the document delivery passage 22.

The paper feeding unit 12 is provided with a guide plate 24 that defines the document introduction passage 20, and guide plates 26 and 28 that are disposed opposed thereto. The document introduction means is provided for the paper feeding unit 12. The document introduction means includes an introduction roller 30 disposed along the document introduction passage 20, a pair of separation rollers 32, and a pair of resist rollers 34. An introduction port 21 (see FIG. 2) is formed at the most upstream position of the document introduction passage 20 in the paper feeding unit 12. The paper feeding unit 12 further includes an open/close frame 38 which is supported to pivot on the pivot axis 36 relative to the main frame 10. The pivot axis 36 is so positioned as to extend substantially perpendicularly to the above-mentioned pivot axis of the main frame 10. The open/close frame 38 is supported by bearing means disposed on the pivot axis 36 and turns relative to the main frame 10 as will be described later in detail. The guide plate 26 and one of the pair of separation rollers 32 are provided on the side of the open/close frame 38. When the open/close frame 38 is brought to the open position, the guide plate 26 is separated away from the opposing guide plate 24, one of the pair of separation rollers 32 is separated away from the other one, and many portions of the document introduction passage 20 are exposed in the paper feeding unit 12.

The conveyor belt mechanism 17, which will be described later in detail includes a driven roller 40 and a follower roller 42 spaced apart from each other in the conveying direction (right-and-left direction in FIG. 2), as well as an endless belt 44 wrapped round these rollers, and a plurality of pressing rollers 46. When the main frame 10 is brought to the closed position, the conveyor belt mechanism 17 is positioned with face toward the upper surface of the platen glass 8. The active running portion, i.e., the lower running portion, of the endless belt 44 is pressed onto the upper surface of the platen glass 8 due to the action of the pressing rollers 46. As the endless belt 44 is rotated by a rotary drive source that will be described later, the document is conveyed from the left toward the right along the upper surface of the platen glass 8. The paper discharging unit 14 includes a pair of guide plates 48 that define the document delivery passage 22. The document delivery means is provided for the paper discharging unit 14. The document delivery means includes a pair of delivery rollers 50 and a pair of discharge rollers 52, both pairs of rollers 50 and 52 being disposed along the document delivery passage 22. A document discharge port 54 is formed on the downstream side of the pair of discharge rollers 52 in the paper discharging unit 14.

The documents that are stacked on the document-placing table 16 are conveyed by the rollers 30, 32 and 34 in the paper feeding unit 12 piece by piece from the introduction port 21 toward the conveyor belt mechanism 17 through the document introduction passage 20. The document is located at a predetermined position on the upper surface of the platen glass 8 owing to the action of the conveyor belt mechanism 17. Then, predetermined steps of copying are carried out by the copying machine 4. After the steps of copying are finished, The document is conveyed by the conveyor belt mechanism 17 toward the paper discharging unit 14. The document is discharged onto the document discharging tray 18 from the discharge port 54 by the rollers 50 and 52 in the paper discharging unit 14 through the document delivery passage 22. The basis of constitution and action of the ADF2 have been disclosed in the specification of Japanese Laid-Open Patent Publication No. 88486/1993 filed on Sep. 30, 1991 (U.S. patent appln. Ser. No. 07/953,969. European Laid-Open Patent Publication No. 0535648). According to the present invention, the fundamental constitutions and functions of the paper feeding unit 12, paper discharging unit 14 and conveyor belt mechanism 17 may be those which have been known per sec, and are not described in further detail here.

Figure 4:
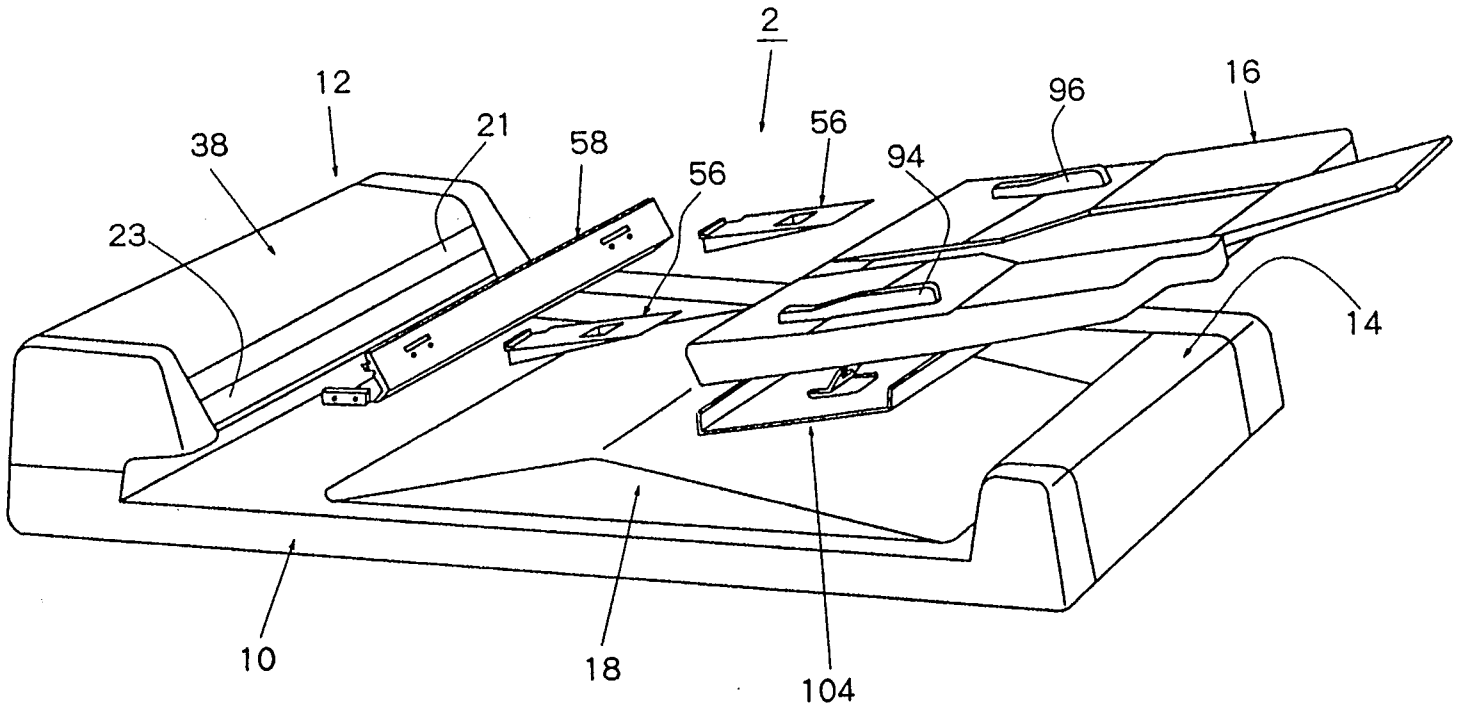
FIG. 4 is a perspective view showing, in a disassembled manner, part of the automatic document feeder of FIG. 3.

Next, described below is a mechanism for mounting the document-placing table 16 on the paper feeding unit 12. With reference to FIGS. 3 and 4, the paper feeding unit 12 is provided with a table support means, and the document placing table 16 is so mounted on the table support means that its position can be adjusted by being moved in the back-and-forth direction of the copying machine 4. With reference to FIG. 4, the table support means is constituted by a pair of table support members 56 that have substantially the same constitution. The table support members 56 are secured to a stay 58, that is provided for the paper feeding unit 12 in a manner to protrude from the paper feeding unit 12, and are spaced at a predetermined distance from each other in the back-and-forth direction of the copying machine 4.

Figure 5:
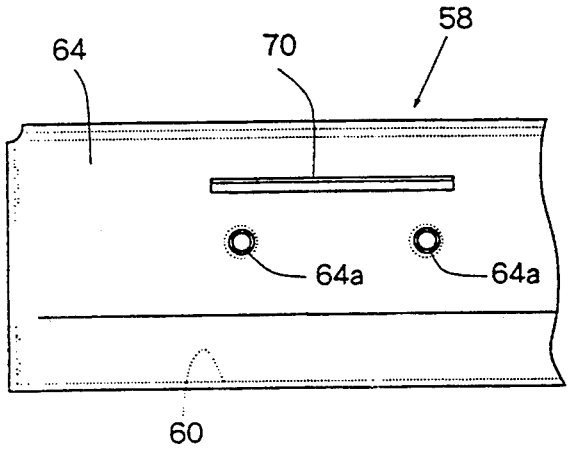
FIG. 5 is a front view which partly shows a stay component depicted in FIG. 4.
Figure 6:
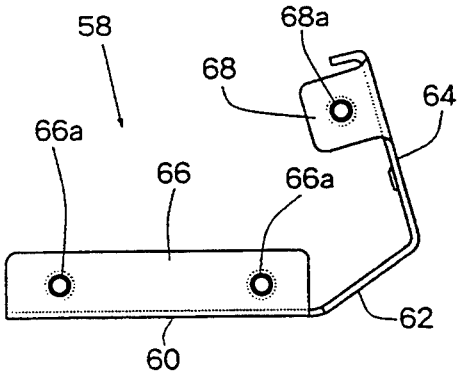
FIG. 6 is a left side view of FIG. 5.

The stay 58 is secured to a lower portion of the introduction port 21 of the paper feeding unit 12. Referring to FIGS. 4 to 6, the stay 58 is formed from a metal plate that is folded in nearly an L-shape as viewed from the side surface thereof. That is, the stay 58 has a horizontal portion 60, a tilted portion 62 that upwardly extends in a tilted manner from an end of the horizontal portion 60, and a mounting portion 64 that upwardly extends from an end of the tilted portion 62 and is slightly tilted from the vertical direction toward the horizontal portion 60 side. The horizontal portion 60 and the mounting portion 64 are provided at their both ends with attaching flanges 66 and 68 for being attached to the paper feeding unit 12. Each attaching flange 66 has two screw holes **66*a*, and each attaching flange 68 has a screw hole 68*a*. The mounting portion 64 has substantially the same slits 70 formed nearly at its both ends thereof. Two screw holes 64*a* are formed under each of the slits 70. The stay 58 is inserted in an opening 23 (see FIG. 4) in a manner to shut the opening 23 which is formed under and along the introduction port 21 of the paper feeding unit 12. By utilizing the attaching flanges 66 and 68, the stay 58 is secured to a pair of upright side plates 72 and 74 (see FIG. 19) that will be described later and that are provided for the main frame on both sides of the paper feeding unit 12**.

Figure 7:
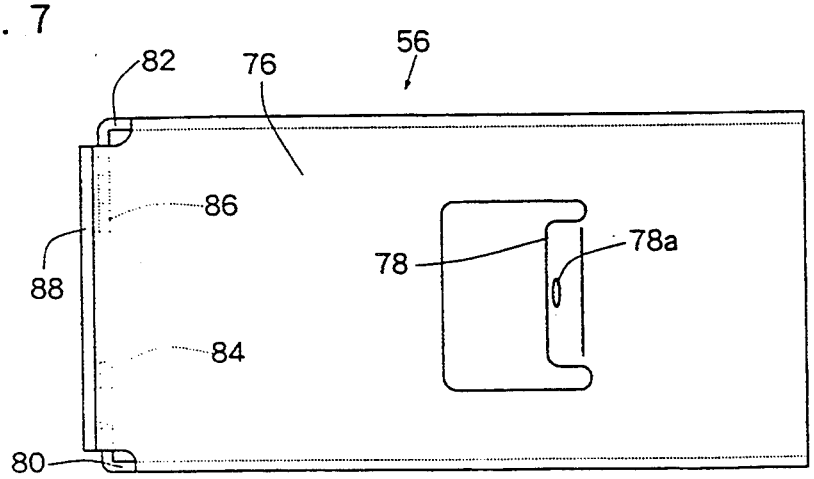
FIG. 7; an top plan view of a table support member depicted in FIG. 4.
Figure 8:
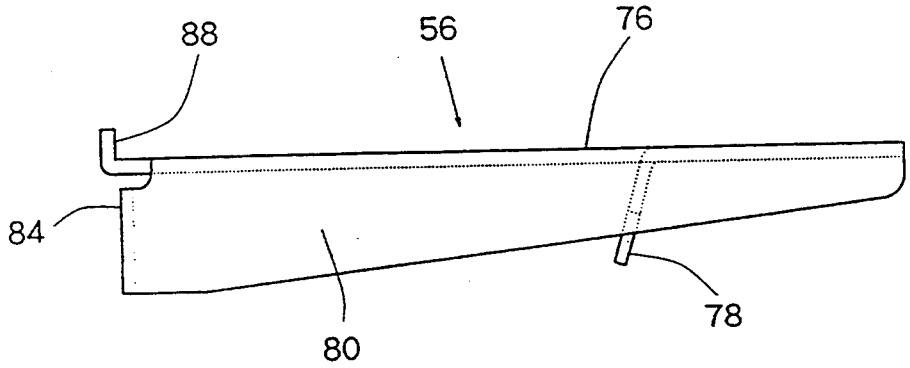
FIG. 8 is a side view of the table support member of FIG. 7 is
Figure 9:
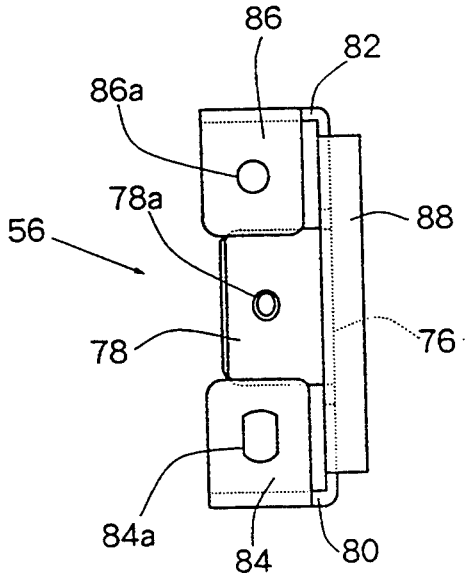
FIG. 9 is an end view of the table support member of FIG. 7.

The table support members 56 have substantially the same constitution, and only one of them will be described here. With reference to FIGS. 7 to 9, the table support member 56 is formed by folding a metal plate and has a flat receiving surface 76 of substantially a rectangular shape formed in an upper portion thereof. At the central portion of the receiving surface 76 is formed by punching a mounting portion 78 that downwardly protrudes in a tilted manner. The mounting portion 78 has a mounting hole **78*a*. Downwardly extending flanges 80 and 82 are formed on both sides of the receiving surface 76, and at the ends of the flanges are formed attaching flanges 84 and 86 that are folded in directions to meet each other. In each of the attaching flanges 84 and 86 is formed a mounting hole 84*a* and 86*a*, respectively. The mounting hole 84*a* is of an oblong shape. An upwardly folded flange 88 for hooking is provided at an end of the receiving surface 76. To mount the table support member 56 on the stay 58, the flange 88 of the table support member 56 is inserted (hooked) in the slit 70 of the stay 58. Positions of the mounting holes 84*a* and 86*a* of attaching flanges 84 and 86 of the table support member 56 are brought into agreement with positions of the screw holes 64*a* of the stay 58, and table support member 56 and stay 58 are secured together using screws that are not shown (see FIG. 16). As described above, the table support members 56 are mounted on the portions of the slits 70 of the stay 58**.

Figure 10:
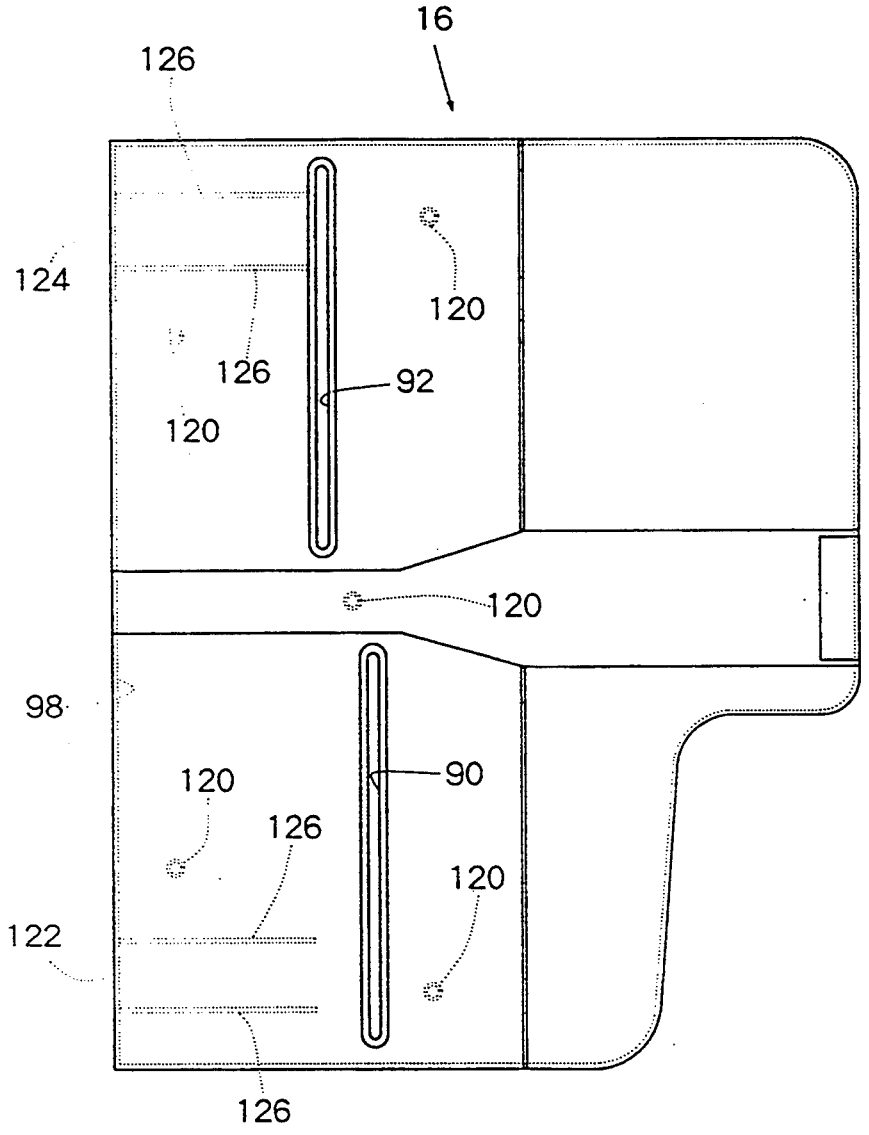
FIG. 10 is a plan view showing major portions of the document-placing table of FIG. 4.
Figure 11:
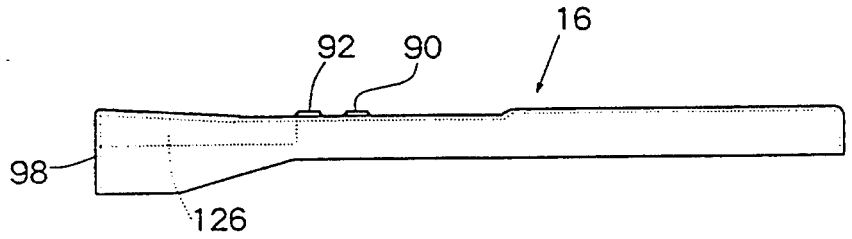
FIG. 11 is a side view of the portions of the document table shown in FIG. 10.
Figure 12:
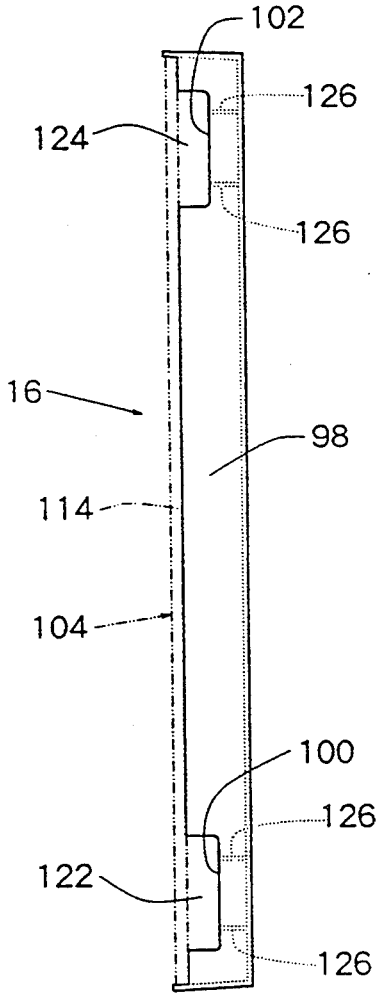
FIG. 12 is an end view of the portions of the document-placing table shown in FIG. 10.
Figure 16:
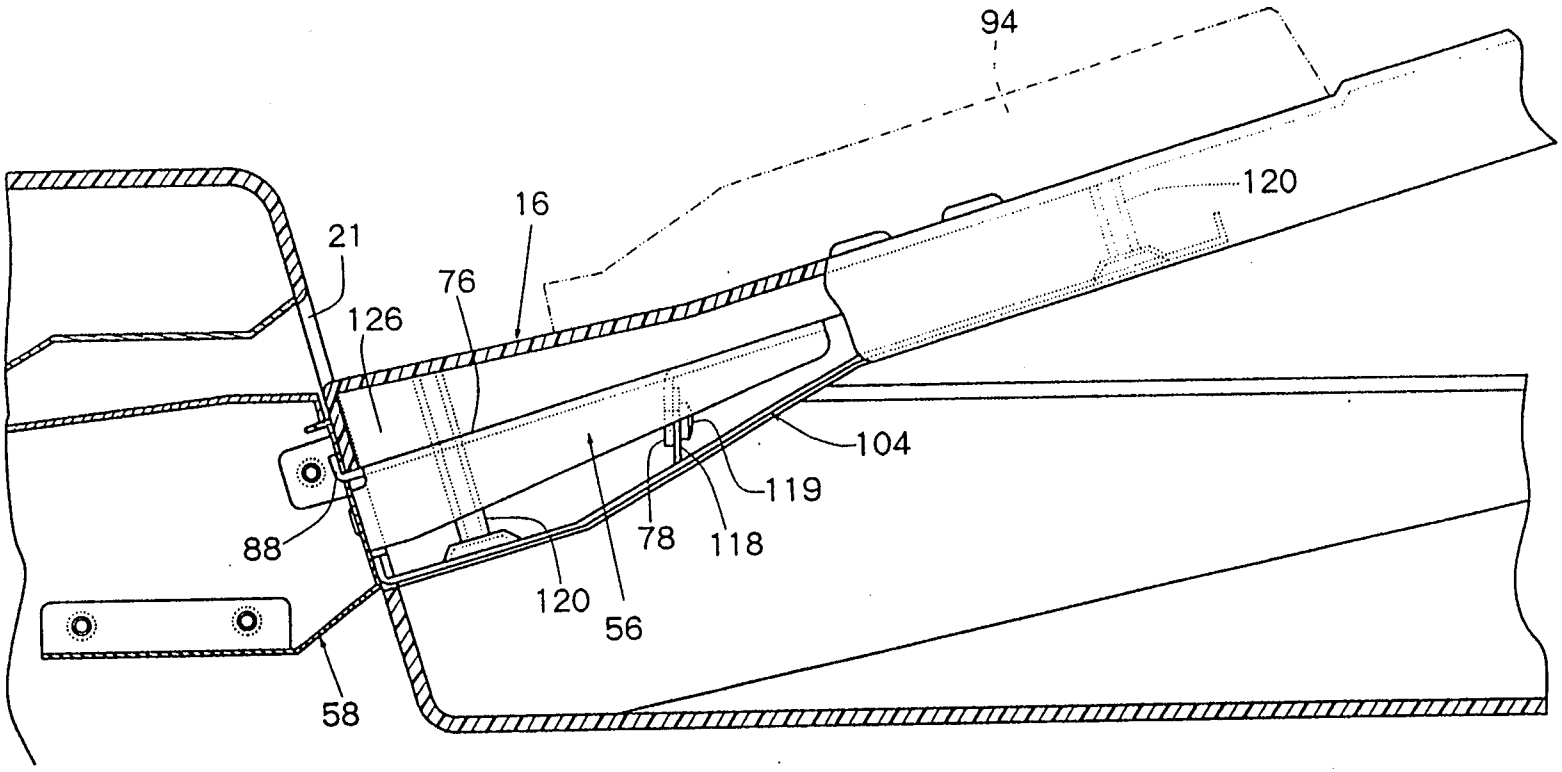
FIG. 16 is a side view showing the state where the document-placing table is mounted on the paper feeding unit.

Described below is the document-placing table 16 mounted on the table support members 56. With reference to FIGS. 10 to 12, the document-placing table 16 has a flange around the circumference thereof and is made of a synthetic resin member of substantially a box shape with its lower side open. When viewed on a plane, the document-placing table 16 has a rectangular shape, part of which being cut away, and has in the upper surface thereof two guide slits 90 and 92 that extend straight in the direction of width. Into the slits 90 and 92 are movably fitted width defining members 94 and 96 that are shown in FIG. 4 to define the width of the document. Two recessed portions 100 and 102 with their lower sides open are formed in a flange 98 that is formed at one end portion of the document-placing table 16. Referring to FIG. 16, a bottom plate 104 is attached to the lower side of the one end portion of the document-placing table 16 spaced at a predetermined distance therefrom.

Figure 13:
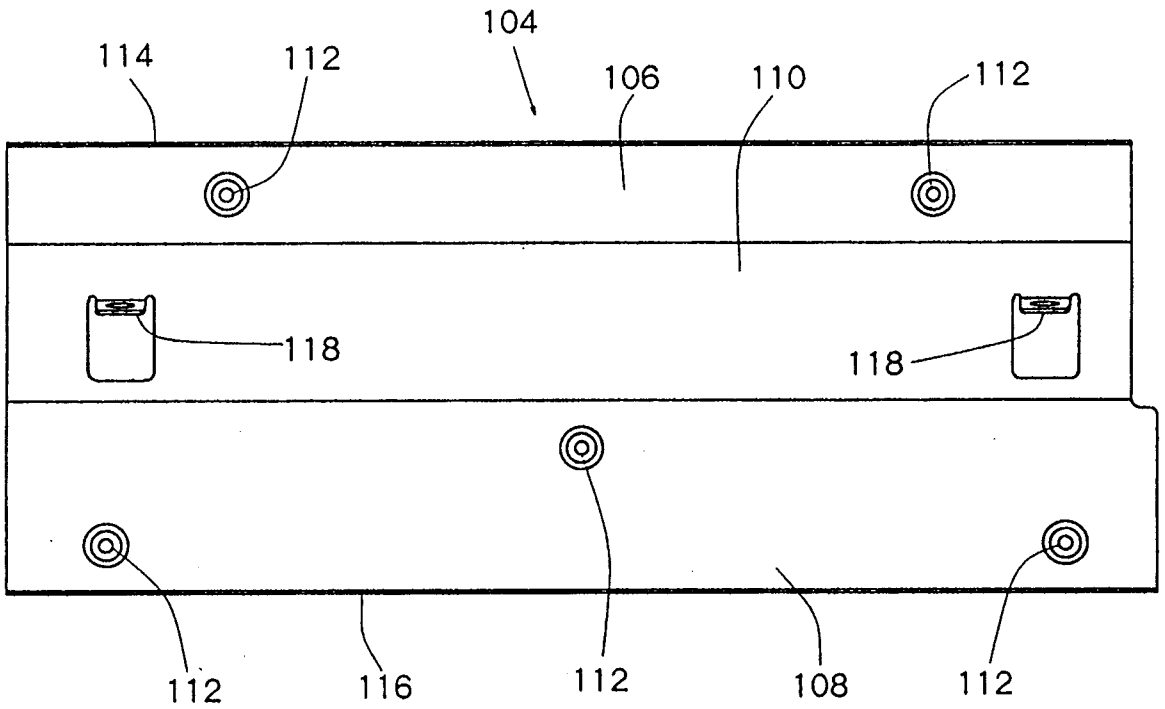
FIG. 13 is a plan view showing a bottom plate of FIG. 4.
Figure 14:
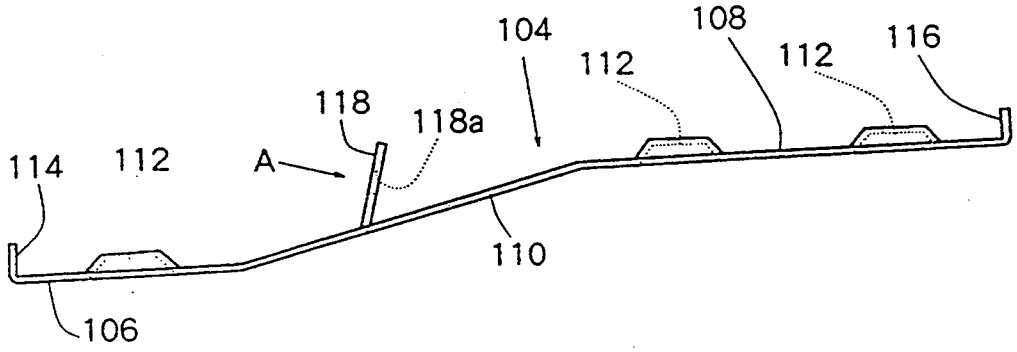
FIG. 14 is a side view on an enlarged scale of the bottom plate of FIG. 13.
Figure 15:
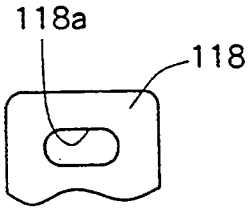
FIG. 15 is a fragmentary view of the bottom plate of from the direction of arrow A in FIG. 14.

With reference to FIGS. 13 to 15, the bottom plate 104 as viewed on a plane is constituted by a metal plate of substantially a rectangular shape, and has horizontal portions 106 and 108, as well as an inclined portion 110 located therebetween. Two attaching holes 112 are formed in the horizontal portion 106, and three attaching holes 112 are formed in the horizontal portion 108. The attaching holes 112 are formed with dish-like protruded portions that are formed directing upwards from the bottom plate 104. The bottom plate 104 has flanges 114 and 116 formed extending upwards at the one end and at the other end. In the inclined portion 110 two attaching portions 118 are formed by punching and are spaced from each other in the lengthwise direction thereof. The attaching portions 118 upwardly extend in a tilted manner and have an oblong attaching hole **118*a*, respectively. On the lower surface of the document-placing table 16 are formed five bosses 120 (see FIGS. 10 and 16) protruding downwards. A threaded hole is formed in each of the bosses 120. Arrangement of these bosses is substantially the same as that of the attaching holes 112 formed in the bottom plate 104. The bottom plate 104 is fastened to the lower surface of the document-placing table 16 by using screws that are not shown under the condition where the attaching holes 112 of the bottom plate 104 are in match with the threaded holes of the bosses 120**.

With reference to FIG. 16 together with FIGS. 11 and 12, the flange 114 of the bottom plate 104 is positioned under the flange 98 of the document-placing table 16 under the condition where the bottom plate 104 is mounted on the document-placing table 16. Therefore, openings 122 and 124 are formed between the flange 114 of the bottom plate 104 and the recessed portions 100 and 102 in the flange 98 of the document-placing table 16. The openings 122 and 124 have substantially the same constitution and have a substantially rectangular shape that can be fitted to the table support members 56. The openings 122 and 124 are wider than the table support members 56. In the lower portion of the document-placing table 16 on the inside of the openings 122 and 124 are formed placing portions 126 that come in contact with the receiving surfaces 76 of the table support members 56. The placing portions 126 are each constituted by the lower surfaces of two ribs that extend from the inside toward the rear side of the openings 122 and 124. With reference to FIG. 16, when the openings 122 and 124 of the document-placing table 16 are fitted to the table support members 56, the placing portions 126 of the document-placing table 16 are placed on the receiving surfaces 76 of the table support members 56. Furthermore, the attaching portions 118 provided on the bottom plate 104 of the document-placing table 16 come in contact with the mounting portions 78 of the table support members 56 to define the position of insertion thereof. Then, the oblong attaching holes 118*a* of the attaching portions 118 are brought into agreement with the mounting holes 78*a* of the mounting portions 78. The oblong attaching holes 118*a* are then moved in the direction of width relative to the mounting holes 78*a* (in the back-and-forth direction of the copying machine 4) to adjust the document-placing table 16 for its mounting position on the table support members 56, and is fastened by screws 119.

Since the document-placing table 16 is supported by the paper feeding unit 12 in a manner as described above, deviation between the optical axis of the copying machine 4 and the center line of the document fed the ADF 2 in the back-and-forth direction is adjusted by moving the document-placing table 16 in relation to the table support members 56 in the back-and-forth direction of the copying machine 4. As a result, the deviation can be adjusted very easily by moving neither the whole ADF 2 nor the paper feeding unit 12. Even in the case of a large ADF mounted on a large copying machine, the operator can bear a reduced burden contributing to greatly improving the operability.

Described below is the constitution of bearing portions of the open/close frame 38 in the paper feeding unit 12. With reference to FIGS. 1 and 17 to 19, the paper feeding unit 12 includes the opening/closing frame 38 which has a pair of side wall plates 130 and 132 which are disposed spaced at a predetermined distance in the back-and-forth direction of the copying machine 4. The main frame 10 is provided with a pair of upright side plates 72 and 74 that are respectively positioned adjoining the outer sides of the side wall plates 130 and 132 of the open/close frame 38. The side wall plates 130 and 132 are supported by the upright side plates 72 and 74 via bearing means, whereby the open/close frame 38 is pivotally mounted on the main frame 10 to be turned between the closed position and the open position. The bearing means includes at least one hollow bearing 134. That is, in this embodiment, the bearing means are constituted by a short shaft 136 secured to the upright side plate 74 and the hollow bearing 134 secured to the upright side plate 72. Specifically, with reference to FIG. 19, support holes 72*a* and 74*a* of the same diameter are formed in the upright side plates 72 and 74, and support holes 130*a* and 132*a* of the same diameter are formed in the side wall plates 130 and 132. These support holes have a common axis under the condition where the open/close frame 38 is mounted. To an end of the short shaft 136 is fastened a mounting flange 138 at right angles thereto. The short shaft 136 is inserted in the support holes 74*a* and 132*a*, and the mounting flange 138 is fastened to the upright side plate 74 with a screw 140, so that the short shaft 136 is secured to the upright side plate 74. The support hole 132*a* of the side wall plate 132 is rotatably supported by the short shaft 136.

Figure 17:
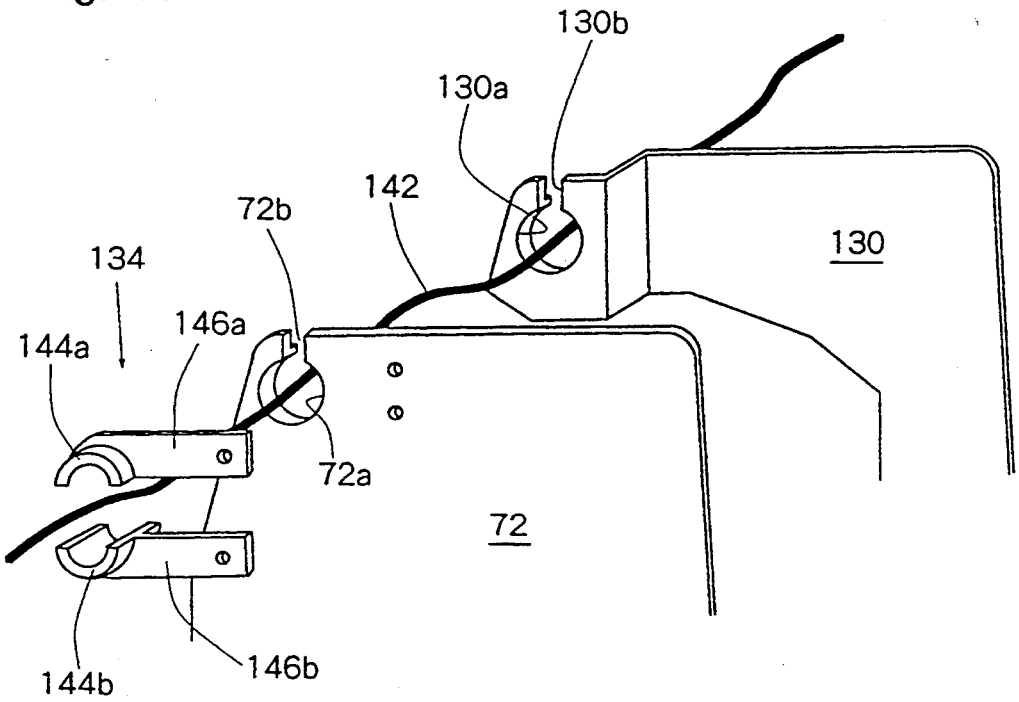
FIG. 17 is a fragmentary perspective view partly showing, in a disassembled manner, one of the bearing portions of the open/close frame in the automatic document feeder of FIG. 1.
Figure 18:
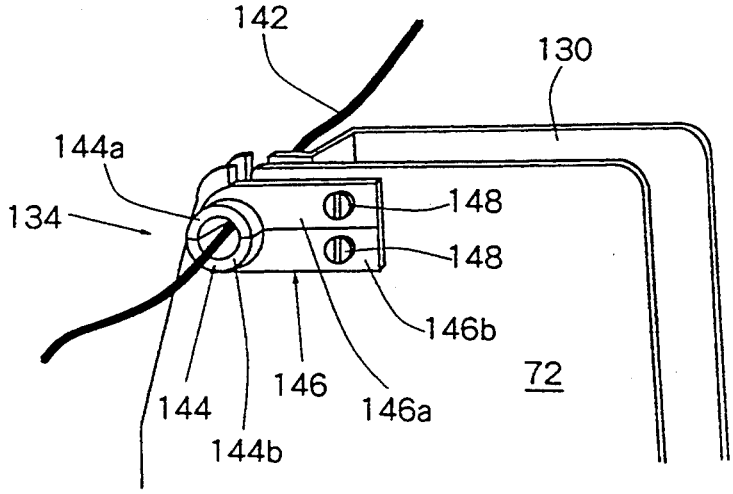
FIG. 18 is a fragmentary perspective view illustrating the assembled state of the portion of the open/close frame depicted in FIG. 17.
Figure 19:
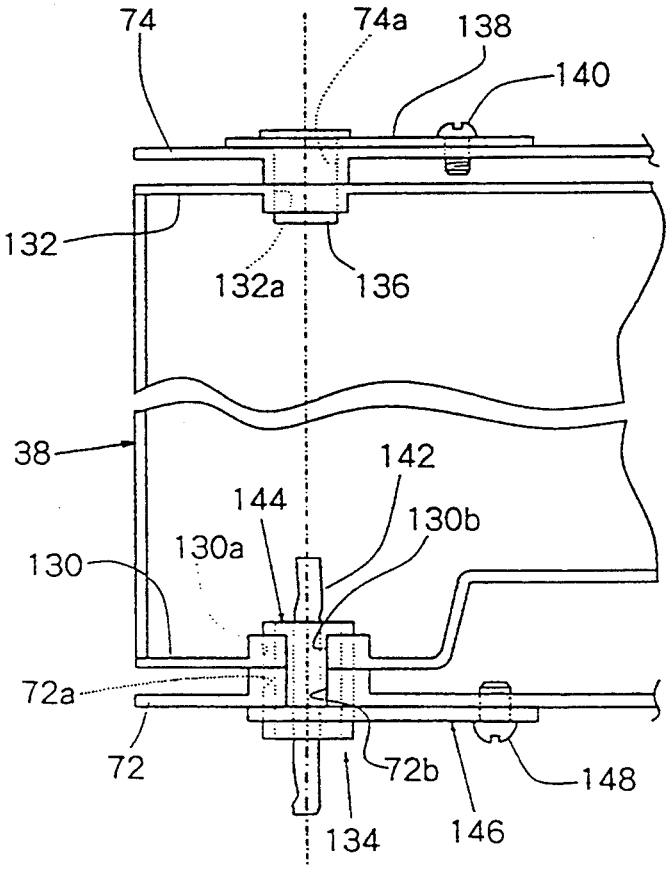
FIG. 19 is a plan view which schematically illustrates the bearing portions of the open/close frame in the automatic document feeder of FIG. 1.

The side wall plate 130 and the upright side plate 72 have notches 130*b* and 72*b* that extend from the upper ends thereof to the support holes 130*a* and 72*a*. With reference to FIG. 19, the notches 130*b* and 72*b* are so positioned as to be brought into agreement with each other in the axial direction of the open/close frame 38 when frame 38 is at the closed position, and have a width enough for the electric wire 142 to pass through. The hollow bearing 134 includes a hollow cylindrical portion 144 having a predetermined length in the axial direction and a mounting frame portion 146 that outwardly extend in the radial direction from the outer peripheral surface at one end of the hollow cylindrical portion 144. The hollow cylindrical portion 144 is inserted in the support holes 72*a* and 130*a*, and the mounting flange portion 146 is secured to the upright side plate 72 by using a screw 148, so that the hollow bearing 134 is secured to the upright side plate 72. The support hole 130*a* of the side wall plate 130 is rotatably supported by the hollow cylindrical portion 144. With reference to FIGS. 17 and 18, the hollow bearing 134 is formed in a manner that it is split into two along a split plane that extends in the axial direction thereof. The split plane in this embodiment is a plane along the axis of the hollow bearing 134. The split plane further includes the hollow cylindrical portion 144 and the mounting flange portion 146. Therefore, the hollow cylindrical portion 144 is divided into two, i.e., into portions 144*a* and 144*b*, and the mounting flange portion 146 is divided into two, i.e., into portions 146*a* and 146*b*, and two screws 148 secure these portions to upright side plate 72.

With the bearing portion of the open/close frame 38 being constituted as described above, the electric wire can be inserted in the support holes 130*a* and 72*a* through the notches under the condition where the positions of the notches 130*b* and 72*b* are brought into agreement with each other in the axial direction. That is, the electric wire 142 that connects between the main frame 10 and the open/close frame 38 is laid on in advance through the support holes 130*a* and 72*a* with a connector that is not shown being fitted thereto prior to mounting the hollow bearing 134. Thereafter, the split portions of the hollow bearing 134 are abutted together with the electric wire 142 passing through the hole. The hollow bearing 134 is then secured to the upright side plate 72 of the main frame 10 while being inserted in the support holes 130*a* and 72*a*. Therefore, there is no need of passing the electric wire through the hole of the bearing in advance, and thus the wiring operation becomes easy and the operation efficiency is greatly improved. Since the electric wire 142 passes through the shaft, no mechanism is required for adjusting the movement of the electric wire 142 with the opening and closing operations of the open/close frame 38. Accordingly, the constitution is simplified and is fabricated at a reduced cost. The appearance is improved, too. Moreover, the electric wire 142 does not receive undesired force and is prevented from being deteriorated or damaged.

Next, described below is the document discharging tray 18. With reference to FIGS. 1 to 3, on the upper surface of the covering between the paper feeding unit 12 and the paper discharging unit 14 of the main frame 10 is provided the document discharging tray 18 on which will be stacked the documents discharged from the discharge port 54 of the paper discharging unit 14. As described earlier, to the paper feeding unit 12 is attached the document placing table 16 in a manner to extend over the document discharging tray 18. On the document discharging tray 18 are provided an ascending inclination 18*a* that rises in the direction in which the document is discharged (toward the left from the right in FIGS. 1 to 3) and a descending inclination 18b that is continuous to the ascending inclination 18*a* and that descends in the direction in which the document is discharged. The vertex 18*c* of the document discharging tray 18, formed by the inclinations 18*a* and 18*b*, is located at a position that is separated from the discharge port 54 of the paper discharging unit 14 in the document discharging direction by more than one-half the maximum size of the document that can be used. In this embodiment, the maximum document size is A2, and the document discharging tray 18, of which both ends are defined by the discharge port 54 of the paper discharging unit 14 and the inner portion of the paper feeding unit 12, has a full length which is greater than the length of A2 in the lengthwise direction thereof. The above-mentioned vertex 18*c* is located at a position which is separated toward the left from the discharge port 54 of the paper discharging unit 14 by more than one-half the length of A2 in the lengthwise direction thereof.

Since the document discharging tray 18 is constituted as described above, the trailing ends of either documents of large sizes such as A2 or documents of small sizes are prevented from being separated away from the discharge port 54 of the discharging unit 14 by more than a predetermined distance. Accordingly, positions of the trailing ends of the documents are not greatly disturbed but are brought into the required position nearly correctly. Therefore, the succeeding documents do not come under the preceding documents, and the documents are prevented from being curled. Thus, the documents are guaranteed to be satisfactorily stacked at all times.

Figure 20:
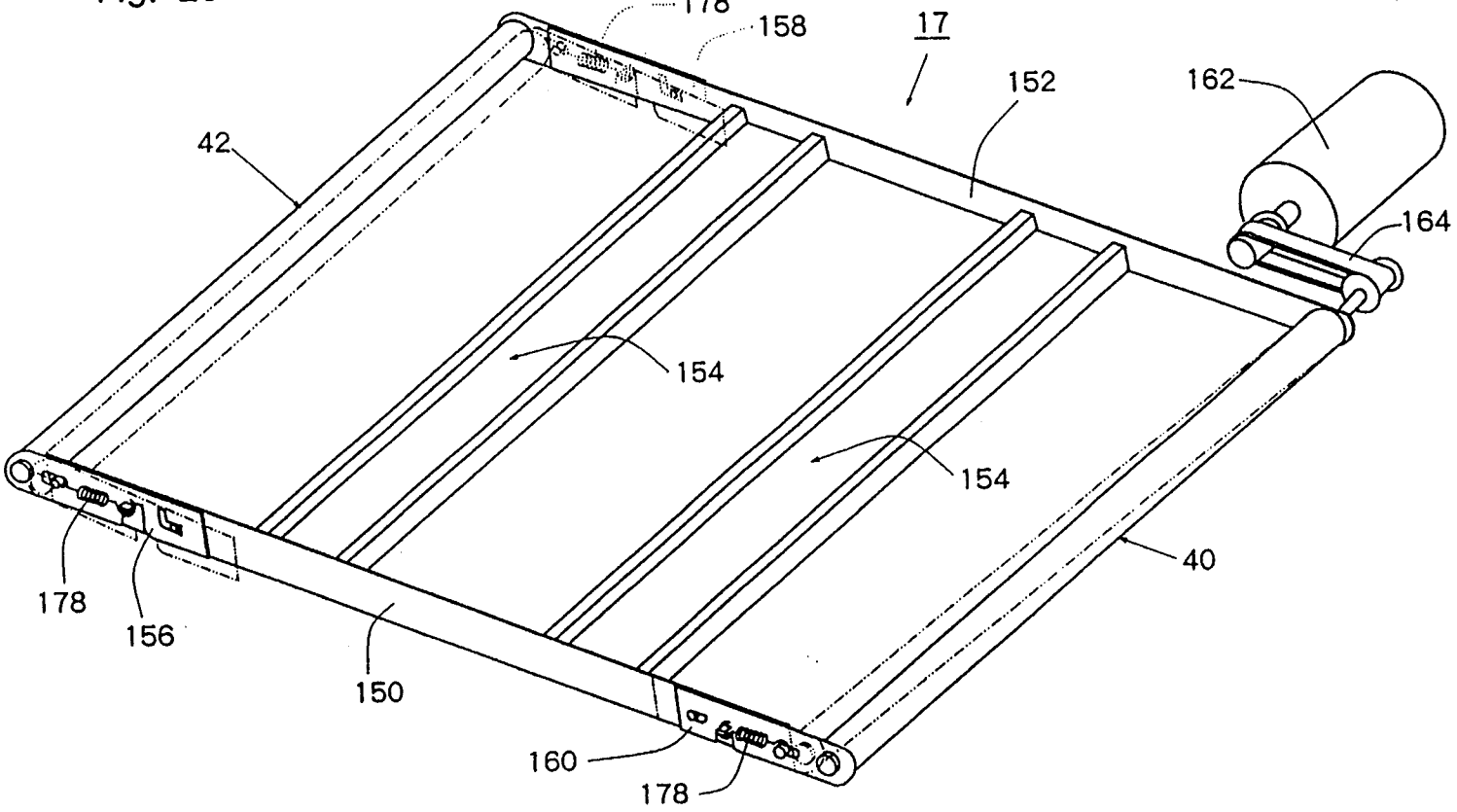
FIG. 20 is a perspective view which schematically illustrates a conveyor belt mechanism included in the automatic document feeder of FIG. 1.

Described below in further detail is the conveyor belt mechanism 17. With reference to FIG. 20, the conveyor belt mechanism 17 includes a front side frame 150 and a rear side frame 152 arranged at a distance in the back-and-forth direction of the copying machine 4, and coupling means 154 for coupling front side frame 150 and rear side frame 152 together. The front side frame 150 and the rear side frame 152 are, respectively, constituted by a strip-like metal plate member that extends in the conveying direction. The coupling means 154 is constituted by two metal members of a U-shape in cross section having a shallow bottom, and the ends thereof are secured to the front side frame 150 and to the rear side frame 152. To the ends on the one side of the front side frame 150 and the rear side frame 152 (ends on the left side in FIG. 20) and to the end on the other side of the front side frame 150 (end on the right side in FIG. 20) are coupled movable frames 156, 158 and 160, respectively, in a manner to be moved in the lengthwise direction thereof. The movable frames are made of strip-like metal plates, too. A spring means (described later) is provided between the movable frame 156 and the front side frame 150 to urge the movable frame 156 toward the direction (leftwards in FIG. 20) away from the front side frame 150. A spring means (described later) is provided between the movable frame 158 and the rear side frame 152 to urge the movable frame 158 toward the direction (leftwards in FIG. 20) away from the rear side frame 152. Moreover, a spring means (described later) is provided between the movable frame 160 and the front side frame 150 to urge the movable frame 160 toward the direction (rightwards in FIG. 20) away from the front side frame 150. These constitutions will be described later. The ends of the follower roller 42 are rotatably supported at the ends of the movable frames 156 and 158. Moreover, one end of the driven roller 40 is rotatably supported at an end of the movable frame 160, and the other end of the driven roller 40 is rotatably supported at the other end of the rear frame 152 (right end in FIG. 20). The aforementioned belt 44 is wrapped round the driven roller 40 and the follower roller 42. The other end of the driven roller 40 is drivably coupled to a rotary drive source 162, which may be an electric motor provided at the other end side of the rear side frame 152. The rotary drive source 162 and the rotary shaft of the driven roller 40 are coupled together via a transmission belt 164. The belt 44 is driven in a predetermined direction by the rotary drive source 162.

Though not illustrated, the conveyor belt mechanism 17 is supported in the main frame 10 in, for example, the following way. The conveyor belt mechanism 17 is mounted on the pivotable frame that is pivotably supported by the main frame 10. The pivot axis of the pivotable frame extends close to and in parallel with the pivot axis of the main frame 10. A coupling means is provided between the front side of the main frame 10 and the front side of the pivotable frame to releasably couple the pivotable frame to the main frame 10. When the main frame 10 is brought to the closed position under the condition where the pivotable frame is coupled to the main frame 10 by the coupling means, the conveyor belt mechanism 17 is positioned being faced to the platen glass 8. Furthermore, when the main frame 10 is brought to the open position and the coupling of the main frame 10 to the pivotable frame by the coupling means is released, the pivotable frame on which the conveyor belt mechanism 17 is mounted is pivoted on the pivot axis and is separated from the main frame 10. Therefore, the rotary drive source 72 and the transmission belt 74 are supported by said pivotable frame together with the conveyor belt mechanism 17. The support means briefly described above has been disclosed in the specification of the aforementioned Japanese Laid-Open Patent Publication No. 88486/1993. In the present invention, means for supporting the conveyor belt mechanism 17 on the main frame is in no way limited to the aforementioned one, as a matter of course.

Figure 21:
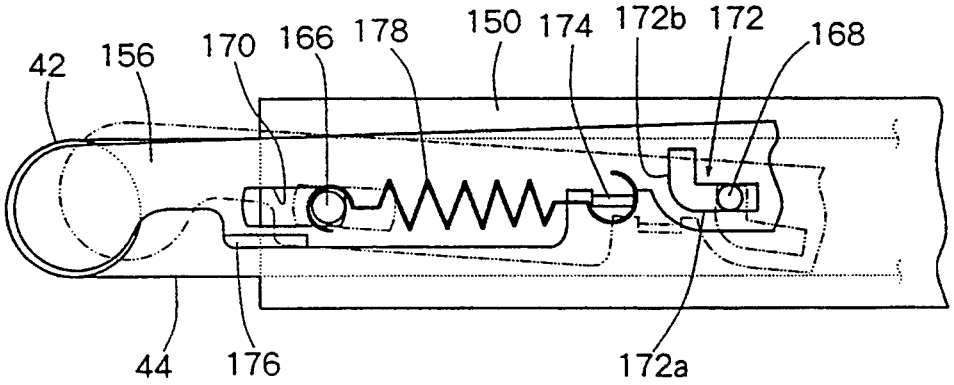
FIG. 21 is a fragmentary front view which schematically illustrates part of the conveyor belt mechanism of FIG. 20.

The movable frame 156 coupled to the front side frame 150 and the coupling thereof have substantially the same constitutions as those of the movable frame 158 coupled to the rear side frame 152 and the coupling thereof. Here, therefore, the constitutions of the movable frame 156 coupled to the front side frame 150 and the coupling thereof will be described. With reference to FIGS. 20 and 21, two forwardly protruded pins 166 and 168 are secured to an end portion of the front side frame 150 spaced at a distance in the conveying direction. In the movable frame 156, on the other hand, are formed two slits 170 and 172 spaced at a distance in the conveying direction. The slit 170 has nearly an oblong shape that slenderly extends in the lengthwise direction of the movable frame 156. The slit 172 extends nearly in an L-shape and has a guide portion 172*a* that extends in the lengthwise direction and an engaging portion 172*b* that extends in the up-and-down direction from an end thereof or that, in this case, extends upwards. The movable frame 156 further has a hook-shaped portion 174 that forwardly protrudes and a grip projection 176 that forwardly protrudes. As shown in FIG. 21, the movable frame 156 is positioned in front of the front side frame 150, and pins 166 and 168 of the front side frame 150 are inserted in the slits 170 and 172, so that the front side frame 150 is combined with the movable frame 156. A tension coil spring 178 that constitutes the above-mentioned spring means is provided between the pin 166 of the front side frame 150 and the hook-shaped portion 174 of the movable frame 156. The tension coil spring 178 urges the movable frame 156 leftwards in FIG. 21, i.e., toward a direction away from the front side frame 150, so that one side of the belt 4 is maintained under the tense condition. The movable frame 156 is held at a tense position indicated by a solid line in FIGS. 20 and 21. In this case, the pin 168 of the front side frame 150 is positioned in the guide portion 172*a* of slit 172 of the movable frame 156. When the movable frame 156 is forcibly moved toward the right in FIG. 21 while overcoming the urging force of the tension coil spring 178 by gripping the grip projection 176 of the movable frame 156 until the pin 168 of the front side frame 150 is positioned in the engaging portion 172*b* in slit 172 of the movable frame 156 as indicated by a two-dot chain line in FIG. 21, the pin 168 comes into engagement with the engaging portion 172*b* of the slit 172. Therefore, even after the operator's hand is removed from the grip projection 176, the movable frame 156 is releasably and temporarily engaged at a non-tense position indicated by a two-dot chain line in FIGS. 20 and 21. Therefore, the engaging portion 172*b* of the slit 172 and the pin 168 constitute an engaging means which releasably anchors the movable frame 156 at the non-tense position.

Figure 22:
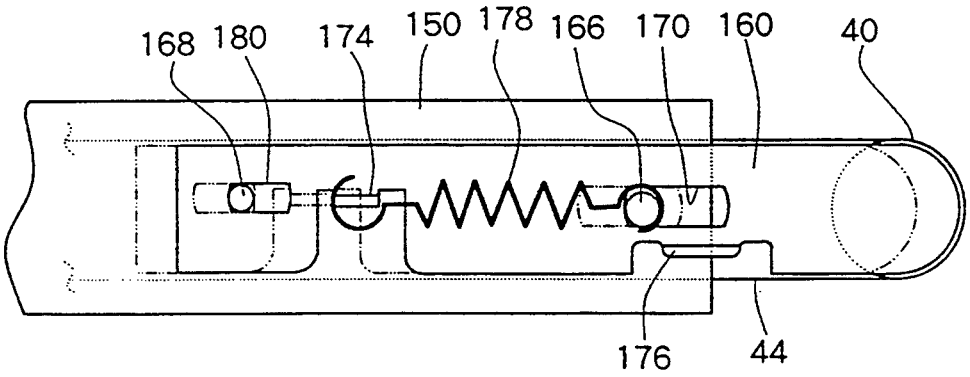
FIG. 22 is a fragmentary front view which schematically illustrates another portion of the conveyor belt mechanism of FIG. 20.

Constitutions of the movable frame 160 coupled to the other end of the front side frame 150 and the coupling thereof will now be described with reference to FIGS. 20 and 22. As will be apparent from the comparison of FIG. 21 with FIG. 22, the movable frame 160 coupled to the other end of the front side frame 150 and the coupling thereof have substantially the same constitutions as those of the movable frame 156 coupled to the front side frame 150 and the coupling thereof except the shape of slits. In FIG. 22, therefore, the portions substantially the same as those of FIG. 21 are denoted by the same reference numerals, and their description is not repeated. The slit 172 of the movable frame 156 is formed in nearly an L-shape as shown in FIG. 21, but a slit 180, formed at a corresponding position in the movable frame 160, has nearly an oblong shape that slenderly extends in the lengthwise direction of the movable frame 160. Therefore, both the slits 170 and 180 of the movable frame 160 have nearly an oblong shape slenderly extending in the same direction. By gripping the grip projection 176 of the movable frame 160, the movable frame 160 is forcibly moved leftwards in FIGS. 22 while overcoming the urging force of the tension coil spring 178, so that the movable frame 160 is releasably and temporarily moved to the non-tension position indicated by two-dot chain lines in FIGS. 20 and 22. When the leftward force is no more applied, the movable frame 160 is held at the tense position indicated by solid lines in FIGS. 20 and 22 due to the urging force of the tension coil spring 178. Therefore, the other side of the aforementioned belt 44 is held under the tense condition.

To replace the belt 44 of the conveyor belt mechanism 17, first, the main frame 10 is brought to the open position indicated by a two-dot chain line in FIG. 1. Then, the coupling means is released to separate the pivotable frame of the conveyor belt mechanism 17 from the main frame 10, remains in the pivotable frame is pivoted to the separation position. While the main frame 10 remains in the open position with its front portion tilted high, the pivotable frame is positioned nearly horizontally, though not illustrated. Thus, the conveyor belt mechanism 17 with its upper surface, so far covered with the main frame 10, is exposed. Thereafter, the movable frames 156 and 158 coupled to the front side frame 150 and to the rear side frame 152 are inwardly moved against the urging force of the tension coil springs 178, and are temporarily anchored at the non-tension position indicated by the two-dot chain line in FIG. 20. As a result, the follower roller 42 is moved to the non-tension position indicated by the two-dot chain line in FIG. 22, and the tension is fully relaxed on the side of the follower roller 42. Next, the movable frame 160 coupled to the other end of the front side frame 150 is inwardly moved against the urging force of the tension coil spring 178 and is brought to the non-tension position indicated by a two-dot chain line in FIG. 22. As a result, as indicated by a two-dot chain line in FIG. 20, the one end side only of the driven roller 40 moves inwardly. Here, it is desired that the movable frames 156 and 158 coupled to the ends on one side of the front side frame 150 and the rear side frame 152 have relatively large moving strokes, and that the movable frame 160 coupled to the other and of the front side frame 150 have a relatively small moving stroke. As will be easily comprehended from the above description, the moving strokes can be determined by the lengths of slits that are formed in the movable frames 156 and 160 extending in the lengthwise direction. This makes it possible to suppress the moving amount on the side of one end of the driven roller 40 to a small amount. When the movable frame 160 is moved, the other end side of the driven roller 40 is slightly tilted at the bearing portion of the rear side frame 152, and this tilt can be fully absorbed by an ordinary bearing. As a result, tension on the belt 44 on the side of the driven roller 40 is fully relaxed without the need of disconnecting the driving coupling between the other end portion of the driven roller 40 and the rotary drive source 162. This serves to fully relax the tension on the belt 44 at both ends of the follower roller 42 and at an end of the driven roller 40, and enables the belt 44 to be easily removed from the rollers 40 and 42. The wrapping of belt 44 between the rollers 40 and 42 can be performed easily through the operation conducted in a reverse manner to the above.

Figure 23:
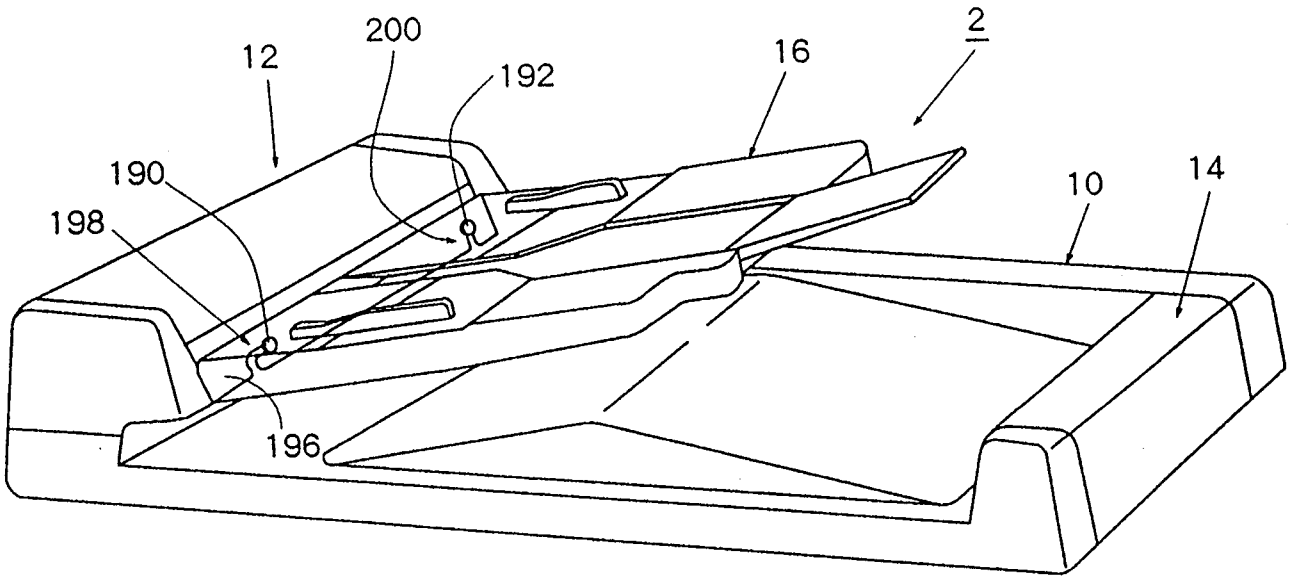
FIG. 23 is a perspective view of an automatic document feeder constituted according to the fifth aspect of the present invention, and perspectively shows part of the document-placing table.
Figure 24:
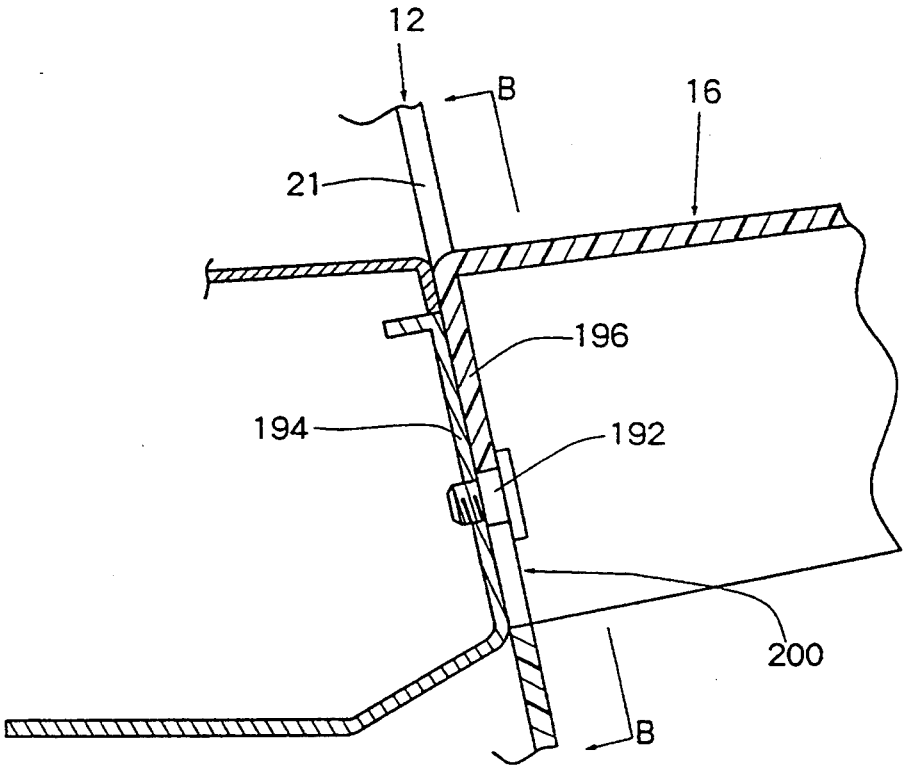
FIG. 24 is a fragmentary sectional view showing mounting of the rear side of the document-placing table of FIG. 23 is taken along the line A—A of FIG. 25.
Figure 25:
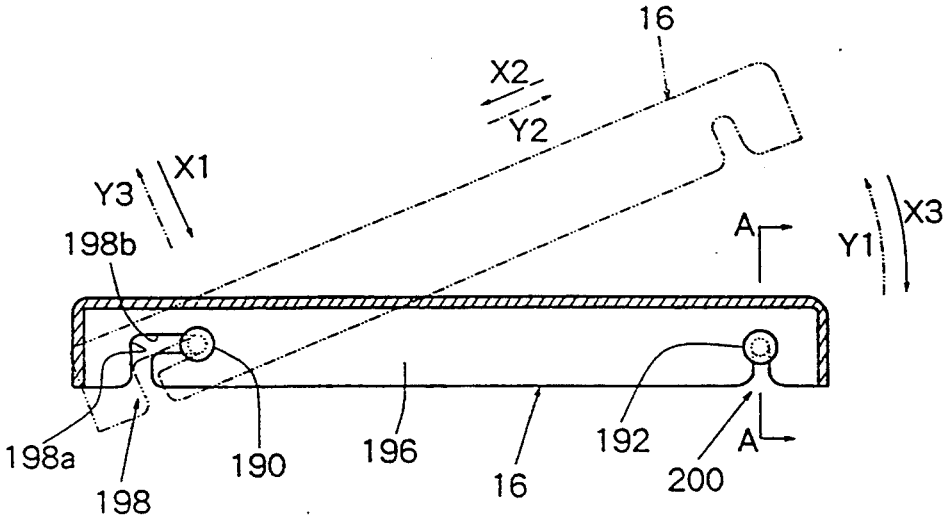
FIG. 25 is a sectional view taken along the line B—B of FIG. 24.

Next, described below is the mechanism for mounting the document-placing table 16. With reference to FIGS. 23 to 25, the paper feeding unit 12 has two support pins 190 and 192 that are disposed in a protruding manner at a distance in the back-and-forth direction of the copying machine 4. Specifically, a stay 194 is provided under the introduction port 21 of the paper feeding unit 12 and extends in the back-and-forth direction of the copying machine 4. The stay 194 is constituted by a metal plate that is folded in nearly an L-shape as viewed in the back-and-forth direction. The support pins 190 and 192 are screwed into the stay 194 at a distance in the back-and-forth direction. The support pins 190 and 192, which are substantially of the same shape, have a threaded portion at one end thereof, a head portion of a large diameter at on the other end thereof, and a circumferential portion at an intermediate portion thereof. The support pin 190 is provided on the front side of the copying machine 4, and the support pin 192 is provided on the rear side thereof.

A downwardly extending flange is formed around the periphery of the document-placing table 16 that is made of a synthetic resin formed as a unitary structure. In a flange portion 196 formed at one end are formed, spaced apart, two mounting notches 198 and 200 having a predetermined width. The predetermined width denotes one which is slightly greater than the diameter of the circumferential portions of the support pins 190 and 192. Under the condition where the document-placing table 16 is mounted, the mounting notch 198 is located on the front side of the copying machine 4 and the mounting notch 200 is located on the rear side. The mounting notch 198 of the front side is constituted by a vertical notch **198*a* that upwardly extends from the lower end of the flange 196 and a lateral notch 198b that laterally extends toward the mounting notch 200 from the upper end of the vertical notch 198*a*. The mounting notch 200 is constituted by a vertical notch that upwardly extends from the lower end of the flange 196. The lower ends of the vertical notches 198*a* and 200 are formed like a funnel. This is for the purpose that the corresponding support pins 190 and 192 will easily engage with the mounting notches 198 and 200. The lateral notch 198*b* of the mounting notch 198 engages with the support pin 190 and the mounting notch 200 engages with the support pin 192, so that the document-placing table 16 is detachably mounted on the paper feeding unit 12. The mounting notches 198 and 200 engage with the circumferential portions of the support pins 190 and 192 and are reliably prevented from escaping in the axial direction due to the heads of the support pins 190 and 192**.

With reference chiefly to FIG. 25, to mount the document-placing table 16 on the paper feeding unit 12, the front side of the document-placing table 16 where the mounting notch 198 is located (left side in FIG. 25) is maintained low and the rear side where the mounting notch 200 is located (right side in FIG. 25) is maintained high. Under this condition, first, the vertical notch **198*a* of the mounting notch 198 is brought into engagement from the upper direction with the support pin 190 located on the front side (see solid arrow X1 of FIG. 25). The upper end of the vertical notch 198*a* is supported by the support pin 190. The document-placing table 16 is then moved toward the front side of the copying machine 4 (see solid arrow X2 of FIG. 25), and the rearmost portion of the lateral notch 198*b* is engaged with the support pin 190. Then, the rear side of the document-placing table 16 which is maintained high is lowered, whereby the document-placing table 16 turns about the support pin 190 as an axis (see solid arrow X3 of FIG. 25), and the mounting notch 200 engages with the support pin 192. The upper end of the mounting notch 200 (vertical notch) is supported by the support pin 192. Through the above-mentioned one-touch operation, the document-placing table 16 can be mounted on the paper feeding unit 12 without using any fastening screws. A solid line in FIG. 25 illustrates the condition where the document-placing table 16 is mounted. Even when the operator tries to lift up the front side of the document-placing table 16 after it is mounted, it never happens that the document-placing table 16 alone is lifted up (removed), owing to the engagement between the lateral notch 198*b* and the support pin 190**.

To remove the document-placing table 16 from the paper feeding unit 12, first, the rear side of the document-placing table 16 is lifted up. The document-placing table 16 upwardly turns with the support pin 190 as an axis (see two-dot chain line arrow Y1 in FIG. 25). Due to this turning motion, the mounting notch 200 of the document-placing table 16 is removed from the support pin 192. Under this condition, the document-placing table 16 is moved rearwardly (see two-dot chain line arrow Y2 in FIG. 25). The lateral notch **198*b* of the mounting notch 198 moves while being supported by the support pin 190, and the upper end of the vertical notch 198a engages with the support pin 190. The two-dot chain line of FIG. 25 represents the condition where the document-placing table 16 is turned. Then, when the front side of the document-placing table 16 is lifted up (see two-dot chain line arrow Y3 in FIG. 25), the vertical notch 198*a* of the mounting notch 198 is removed from the support pin 190. Through the above-mentioned one-touch operation, the document-placing table 16 can be easily removed from the paper feeding unit 12. Thus, the document-placing table 16** can be mounted and removed very easily within reduced periods of time.

The lateral notch **198*b* of the mounting notch 198 is formed to extend in the lateral direction from the upper end of the vertical notch 198*a* toward the other mounting notch 200 (rightwards in FIG. 25). The lateral notch 198*b*, however, may be so formed as to extend in the opposite direction (leftwards in FIG. 25). In this case, the document-placing table 16** is moved in the opposite direction for being mounting or removed, which, however, is basically the same.

In the ADF constituted according to the first aspect of the present invention, any deviation between the optical axis of the image forming machine and the center line of the document fed by the ADF in the back-and-forth direction can be very easily adjusted by moving the document-placing table in the back-and-forth direction without the need of moving the ADF as a whole or the paper feeding unit that is required in the prior art. In the case of a large ADF mounted on a large image forming machine, in particular, the operator can bear a reduced burden and the operation efficiency can be greatly improved.

In the ADF constituted according to the second aspect of the present invention, no cumbersome operation is required such as passing the electric wire through the hole of the bearing in advance and then fitting a connector to the electric wire, as is involved in the prior art. Therefore, inserting the electric wires and the assembling the open/close frame are facilitated, and consequently the operation efficiency is greatly improved. Since the electric wire passes through the shaft, no mechanism is required for adjusting the movement of the electric wire with the opening and closing operations of the open/close frame. Accordingly, the constitution is simplified, the cost decreases and the appearance is improved. Moreover, the electric wire does not receive any undesired force and is prevented from being deteriorated or damaged.

In the ADF constituted according to the third aspect of the present invention, the documents, irrespective of their sizes, are discharged onto the document discharging tray from the discharge port of the paper discharging unit with their trailing ends not so greatly out of position but rather nearly in a required position. Therefore, the succeeding documents do not come under the preceding documents, and the documents are not curled, either, enabling the documents to be satisfactorily stacked at all times.

In the ADF constituted according to the fourth aspect of the present invention, the tension of the belt can be relaxed without disconnecting the driving coupling between the driven roller and the rotary drive source, and the belt can be replaced very easily. As a result, the time for replacing the belt is shortened and the performance of maintenance is improved. Moreover, the belt can be replaced by a new one without requiring forcible removal; i.e., the conveyor belt mechanism does not receive large force and is prevented from being damaged. The belt is not scratched, either.

In the ADF constituted according to the fifth aspect of the present invention, the document-placing table can be mounted on or removed from the paper feeding unit by simply engaging or disengaging the mounting notch formed on the side of the document-placing table with or from the support pin attached to the side of the paper feeding unit. Therefore, the document-placing table is easily mounted or removed through one-touch operation without using fastening screws. As a result, the time for attachment or removal is shortened, and the number of parts can be decreased. Even when the front side of the document-placing table is lifted up by the operator, it never happens that the document-placing table alone is lifted up (removed) owing to the engagement between the lateral notch and one of the support pins.

Though the present invention was described above in detail by way of embodiments, it should be noted that the present invention is in no way limited to the above-mentioned embodiments only but can be changed or modified in a variety of other ways without departing from the scope of the invention.

What we claim is:

1. An automatic document feeder for an imaging processing machine having a housing with a platen glass, said automatic document feeder comprising a main frame adapted to be mounted on the housing for pivoting between a closed position and an open position with respect to the platen glass; a paper feeding unit provided at one end of said main frame; a paper discharging unit provided at the other end of said main frame; and a conveyor belt mechanism disposed to face the platen glass when said main frame is at the closed position, said conveyor belt mechanism extending between said paper feeding unit and said paper discharging unit, said conveyor belt mechanism including:

a front frame;

a rear frame disposed from said front frame at a distance in a direction substantially perpendicular to the longitudinal direction of said conveyor belt mechanism;

coupling means coupling said front frame and said rear frame together;

a first movable frame coupled to a first end said front frame in a manner permitting relative movement of at least a first amount between said first movable frame and said front frame in the lengthwise direction of said conveyor belt mechanism;

a second movable frame coupled to a first end of said front frame in a manner permitting relative movement of at least the first amount between said second movable frame and said rear frame in the lengthwise direction of said conveyor belt mechanism;

a third movable frame coupled to a second end of said front frame in a manner permitting relative movement of at least a second amount, less than the first amount, between said third movable frame and said rear frame in the lengthwise direction of said conveyor belt mechanism;

first spring means connecting said first movable frame and said first end of said front frame to urge said first movable frame away from said first end of said front frame;

second spring means connecting said second movable frame and said first end of said rear frame to urge said second movable frame away from said first end of said rear frame;

third spring means connecting said third movable frame and said second end of said front frame to urge said third movable frame away from said second end of said front frame;

a follower roller supported by said first and second movable frames;

a driven roller having a first end supported by said third movable frame and a second end supported by a second end of said rear side frame;

an endless belt wrapped round said driven roller and said follower roller; and a drive source coupled to said second end of said driven roller for driving said driven roller and said endless belt, movement of said first and second movable frames in a direction toward said driven roller by an amount up to the first amount permitting movement of said follower roller in said direction toward said driven roller to remove tension on said follower roller, and movement of said third movable frame in a direction toward said follower roller by an amount up to the second amount permitting movement of said first end of said driven roller in said direction toward said follower roller to remove tension on said driven roller, while retaining said second end of said driven roller supported by said second end of said rear frame and coupled to said drive source.

2. An automatic document feeder according to claim 1, further comprising engaging means releasably anchoring said first, second, and third movable frames at positions adjacent said front side frame and said rear side frame against urging forces of said spring means.

* * * * *